US012589959B2

(12) United States Patent
Shimosaka et al.

(10) Patent No.: US 12,589,959 B2
(45) Date of Patent: Mar. 31, 2026

(54) MEDIUM CONVEYANCE DEVICE

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 35 days.

(21) Appl. No.: 18/685,440

(22) PCT Filed: Sep. 16, 2021

(86) PCT No.: PCT/JP2021/034163
§ 371 (c)(1),
(2) Date: Feb. 21, 2024

(87) PCT Pub. No.: WO2023/042350
PCT Pub. Date: Mar. 23, 2023

(65) Prior Publication Data

US 2024/0391715 A1 Nov. 28, 2024

(51) Int. Cl.
*B65H 1/26* (2006.01)
*B65H 1/04* (2006.01)
(Continued)

(52) U.S. Cl.
CPC ..... *B65H 1/266* (2013.01); *B65H 1/04* (2013.01); *B65H 3/06* (2013.01); *B65H 3/0661* (2013.01);
(Continued)

(58) Field of Classification Search
CPC . B65H 1/04; B65H 1/06; B65H 1/266; B65H 3/06; B65H 3/063; B65H 3/0661;
(Continued)

(56) References Cited

U.S. PATENT DOCUMENTS 5,568,166 A * 10/1996 Yamazaki ..... B65H 1/266 271/10.01
8,376,350 B2 * 2/2013 Choi ..... B65H 3/0684 271/117
(Continued)

FOREIGN PATENT DOCUMENTS

JP S53-117240 U 9/1978
JP H04-182226 A 6/1992
(Continued)

OTHER PUBLICATIONS

Japanese Office Action dated Sep. 17, 2024 regarding Japanese Patent Application No. 2024-006010 corresponding to U.S. Appl. No. 18/685,440 (4 pages) with English Translation (6 pages).
(Continued)

*Primary Examiner* — Prasad V Gokhale
(74) *Attorney, Agent, or Firm* — Womble Bond Dickinson (US) LLP

(57) ABSTRACT

Provided is a medium conveying apparatus which is prevented from being used with a roller cover open. A medium conveying apparatus includes a housing, a loading tray provided to be attachable and detachable relative to the housing and be movable between a fixed position where the loading tray is fixed to the housing to place a medium and an inclined position inclined relative to the fixed position for mounting the loading tray to the housing, a roller to separate the medium, and a cover provided to be openable and closable relative to the housing and be swingable between a closed position where the cover covers the roller and forms part of a guide surface of a medium and an open position for attaching and detaching the roller. The loading tray includes a contact part to come into contact with the cover and push the cover toward the closed position when the loading tray is located at the inclined position or when the loading tray
(Continued)

moves from the inclined position to the fixed position with the cover located at the open position.

10 Claims, 25 Drawing Sheets

(51) Int. Cl.
*B65H 3/06* (2006.01)
*B65H 3/68* (2006.01)
*B65H 5/38* (2006.01)

(52) U.S. Cl.
CPC ..... *B65H 3/68* (2013.01); *B65H 5/38* (2013.01); *B65H 2402/441* (2013.01); *B65H 2405/114* (2013.01); *B65H 2405/31* (2013.01); *B65H 2405/324* (2013.01); *B65H 2601/321* (2013.01); *B65H 2601/324* (2013.01)

(58) Field of Classification Search
CPC ... B65H 3/66; B65H 3/68; B65H 5/38; B65H 2402/441; B65H 2405/114; B65H 2405/31; B65H 2405/324; B65H 2601/321; B65H 2601/324
See application file for complete search history.

(56) References Cited

U.S. PATENT DOCUMENTS

| | | | | |
|---|---|---|---|---|
| 2008/0310905 | A1 | 12/2008 | Fukumasu | |
| 2017/0113472 | A1 | 4/2017 | Oki et al. | |
| 2017/0279991 | A1* | 9/2017 | Shiota | B65H 5/062 |
| 2018/0118482 | A1* | 5/2018 | Kuriki | B65H 3/0684 |
| 2018/0194579 | A1 | 7/2018 | Harada et al. | |

FOREIGN PATENT DOCUMENTS

| | | | |
|---|---|---|---|
| JP | H07-112853 | A | 5/1995 |
| JP | 3060449 | U | 8/1999 |
| JP | 2004-352380 | A | 12/2004 |
| JP | 2006-315832 | A | 11/2006 |
| JP | 4012857 | B2 | 11/2007 |
| JP | 2008-247521 | A | 10/2008 |
| JP | 2009-269696 | A | 11/2009 |
| JP | 2010-228862 | A | 10/2010 |
| JP | 2013-147335 | A | 8/2013 |
| JP | 2017-77950 | A | 4/2017 |
| JP | 2017-171426 | A | 9/2017 |
| JP | 2018-100135 | A | 6/2018 |
| JP | 2018-108888 | A | 7/2018 |
| JP | 6756970 | B2 | 9/2020 |
| JP | 2008-189400 | A | 8/2021 |

OTHER PUBLICATIONS

International Search Report dated Nov. 22, 2021 for corresponding PCT Application No. PCT/JP2021/034163 (4 pages) with English Translation (3 pages).
Written Opinion dated Nov. 22, 2021 for corresponding PCT Application No. PCT/JP2021/034163 (4 pages) with English Translation (3 pages).
International Preliminary Report on Patentability dated Mar. 5, 2024 for corresponding PCT Application No. PCT/JP2021/034163 (5 pages) with English Translation (4 pages).

* cited by examiner

MEDIUM CONVEYANCE DEVICE

CROSS-REFERENCE TO RELATED APPLICATION(S)

This application is a U.S. National Phase Patent Application and claims priority to and the benefit of International Application Number PCT/JP2021/034163, filed on Sep. 16, 2021, the entire content of which is incorporated herein by reference.

TECHNICAL FIELD

The present disclosure relates to a medium conveying apparatus, and particularly relates to a medium conveying apparatus including a loading tray.

BACKGROUND ART

Generally, in a medium conveying apparatus, such as a scanner, imaging a medium while conveying the medium, a cover of a roller is openably and closably provided to allow replacement of the roller, cleaning of the roller, or elimination of a jammed medium when abrasion of the roller, adherence of paper dust to the roller, or jamming of a medium occurs. For example, when the cover of the roller is not correctly closed in such a medium conveying apparatus after replacement of the roller, cleaning of the roller, or elimination of a jammed medium is performed by a user, a medium may not be suitably conveyed, and jamming or skewing of a medium may occur.

A paper conveying apparatus is disclosed that includes an exterior cover provided on a device body to cover a conveyance guide member and pivotally supported on the device body in an openable and closable manner and a locking member to lock the conveyance guide member to a blocking position (see PTL 1). The paper conveying apparatus includes a pressing member being installed between the exterior cover and the conveyance guide member in a protruding manner and, when the exterior cover moves to the blocking position, shifting the conveyance guide member to the blocking position by pressing the conveyance guide member.

A medium feeding apparatus including a cover member including a cover surface constituting part of the top surface of a lower unit and covering a holding part of a feed roller while exposing part of the feed roller to a conveyance path is disclosed (see PTL 2). In the medium feeding apparatus, the cover member is formed to be removable in a direction including a component toward an upstream side of a conveying direction relative to the lower unit, and a sliding part provided at a downstream side edge of the cover member is attached and detached by being guided along a sliding surface. The sliding part is guided in a direction intersecting with the conveying direction and is determined by the sliding surface.

CITATION LIST

Patent Literature

[PTL 1]
Japanese Patent No. 4012857
[PTL 2]
Japanese Patent No. 6756970

SUMMARY OF INVENTION

It is preferred that a medium conveying apparatus is prevented from being used with a roller cover open.

An object of a medium conveying apparatus is to prevent from being used with the roller cover open.

According to some embodiments, a medium conveying apparatus includes a housing, a loading tray provided to be attachable and detachable relative to the housing and be movable between a fixed position where the loading tray is fixed to the housing to place a medium and an inclined position inclined relative to the fixed position for mounting the loading tray to the housing, a roller to separate the medium, and a cover provided to be openable and closable relative to the housing and be swingable between a closed position where the cover covers the roller and forms part of a guide surface of a medium and an open position for attaching and detaching the roller. The loading tray includes a contact part to come into contact with the cover and push the cover toward the closed position when the loading tray is located at the inclined position or when the loading tray moves from the inclined position to the fixed position with the cover located at the open position.

The medium conveying apparatus according to the present embodiment can be prevented from being used with the cover open.

The object and advantages of the invention will be realized and attained by means of the elements and combinations, in particular, described in the claims. It is to be understood that both the foregoing general description and the following detailed description are exemplary and explanatory, and are not restrictive of the invention, as claimed.

DESCRIPTION OF EMBODIMENTS

Hereinafter, a medium conveying apparatus, a control method and a control program according to an embodiment, will be described with reference to the drawings. However, it should be noted that the technical scope of the invention is not limited to these embodiments, and extends to the inventions described in the claims and their equivalents.

Figure 1:
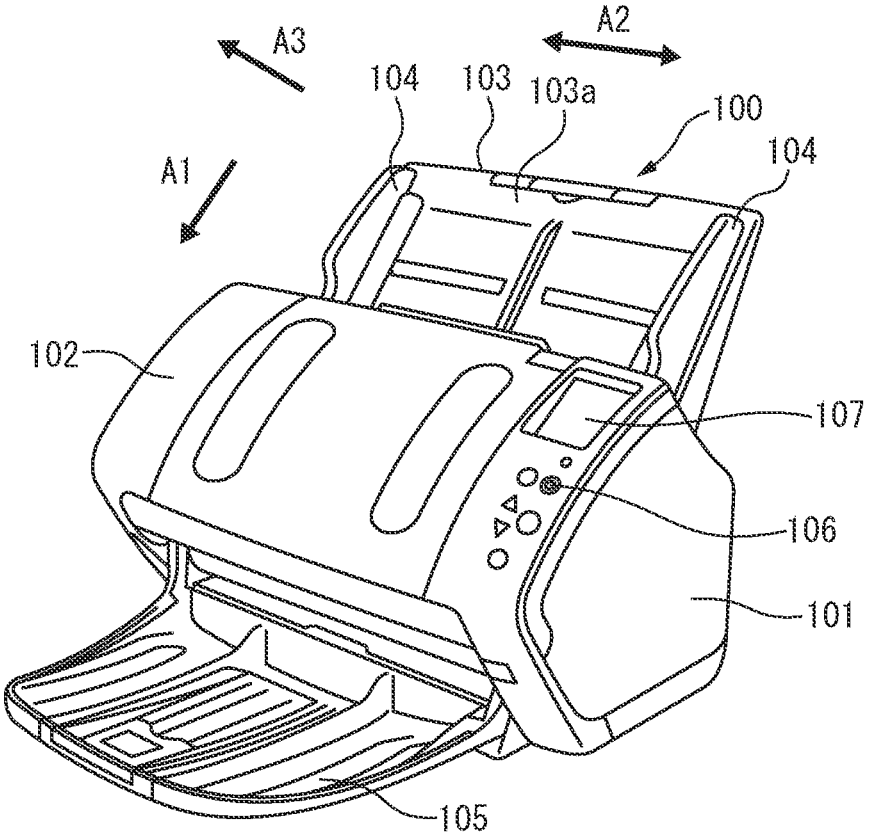
FIG. 1 is a perspective view illustrating a medium conveying apparatus according to an embodiment.

FIG. 1 is a perspective view illustrating an example of a medium conveying apparatus configured as an image scanner. The medium conveying apparatus 100 conveys and images a medium being a document. For example, a medium is paper, thin paper, thick paper, a card, carbon paper, a booklet, or an envelope. The medium conveying apparatus 100 may be a facsimile, a copying machine, a multifunctional peripheral (MFP), etc. A conveyed medium may be an object being printed, etc., instead of a document, and the medium conveying apparatus 100 may be a printer, etc. In FIG. 1, an arrow A1 indicates a medium conveying direction, an arrow A2 indicates a width direction perpendicular to the medium conveying direction, and an arrow A3 indicates a high direction perpendicular to the medium conveying direction A1 and the width direction. Hereinafter, upstream refers to upstream in the medium conveying direction A1, and downstream refers to downstream in the medium conveying direction A1.

The medium conveying apparatus 100 includes a lower housing 101, an upper housing 102, a loading tray 103, a side guide 104, an ejection tray 105, an operation device 106, a display device 107, etc.

The lower housing 101 and the upper housing 102 are examples of a housing. Each of the lower housing 101 and the upper housing 102 is formed of a resin member such as polystyrene (PS) or acrylonitrile butadiene styrene (ABS). The upper housing 102 is located at a position covering the top surface of the medium conveying apparatus 100 and is engaged with the lower housing 101 by a hinge to be openable and closable when, for example, a medium is jammed, or replacement or cleaning of a roller is performed.

The loading tray 103 is engaged with the lower housing 101 to be inclined relative to a horizontal direction. The loading tray 103 may be located almost in parallel with the horizontal direction. The loading tray 103 is formed of a resin member such as PS or ABS. The loading tray 103 includes a placement surface 103*a* on which a medium is placed, to place a fed and conveyed medium. The loading tray 103 is attachable and detachable to the lower housing 101.

The side guide 104 is provided on the placement surface 103*a* of the loading tray 103 to be movable in the width direction A2 perpendicular to the medium conveying direction. The side guide 104 is positioned according to the width of a medium placed on the loading tray 103 and regulates the width direction of the medium. In the example illustrated in FIG. 1, two side guides 104 are spaced in the width direction A2. The number of side guides 104 may be one. The side guide 104 is an example of a contact part.

The ejection tray 105 is engaged with the upper housing 102 and stacks an ejected medium. The ejection tray 105 may be engaged with the lower housing 101.

The operation device 106 includes an input device such as a button, and an interface circuit acquiring a signal from the input device, accepts an input operation by a user, and outputs an operation signal based on the input operation by the user. The display device 107 includes a display including a liquid crystal, an organic electro-luminescence (EL), etc., and an interface circuit outputting image data to the display, and displays the image data on the display.

Figure 2:
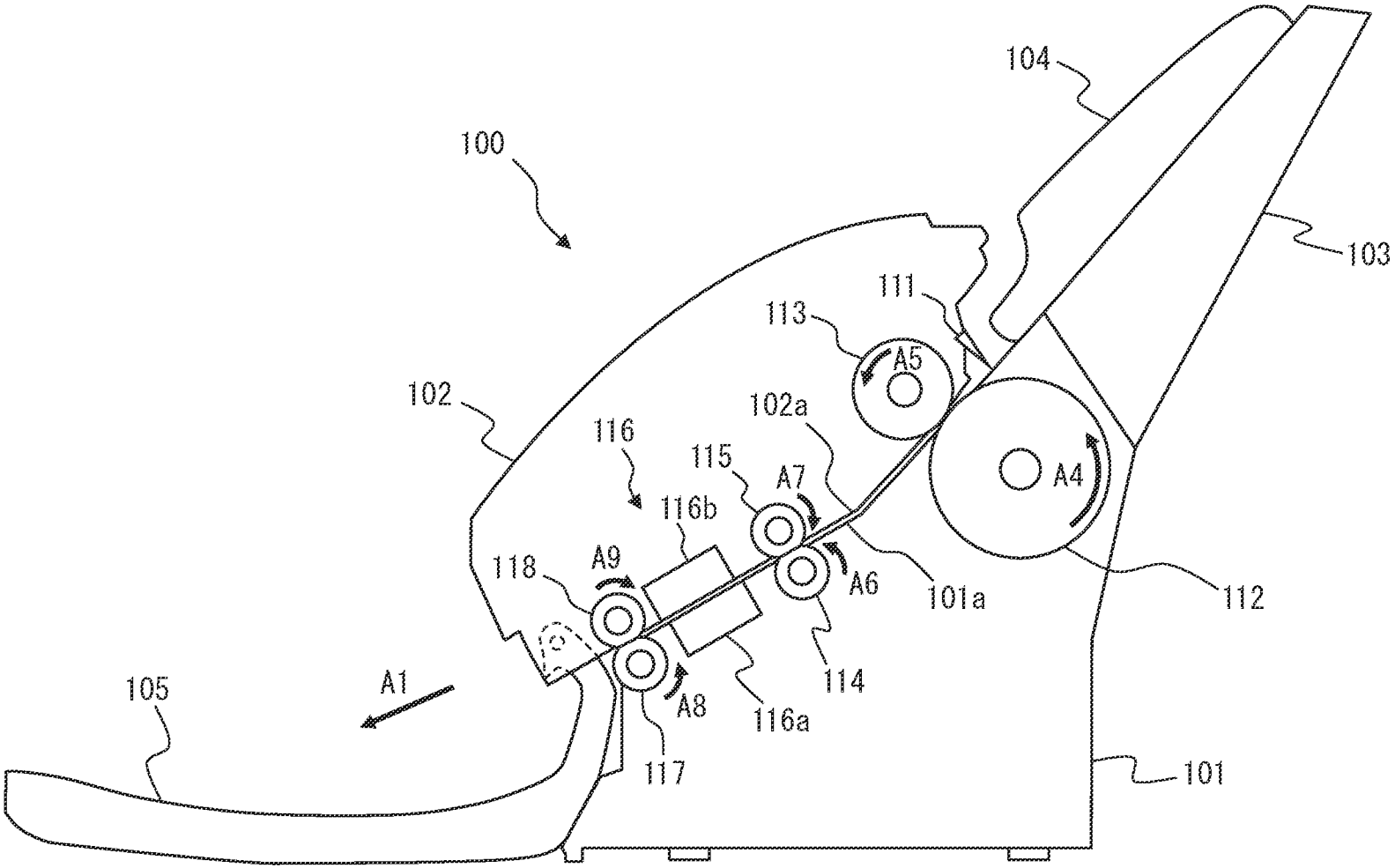
FIG. 2 is a diagram for illustrating a conveyance path inside the medium conveying apparatus.

FIG. 2 is a diagram illustrating an example of a conveyance path inside a medium conveying apparatus.

The conveyance path inside the medium conveying apparatus 100 includes a medium sensor 111, a feed roller 112, a separation roller 113, a first conveyance roller 114, a second conveyance roller 115, an imaging device 116, a first ejection roller 117, a second ejection roller 118, etc.

Each of the numbers of the feed roller 112, the separation roller 113, the first conveyance roller 114, the second conveyance roller 115, the first ejection roller 117, and/or the second ejection roller 118 is not limited to one and may be more than one. In that case, a plurality of feed rollers 112, separation rollers 113, first conveyance rollers 114, second conveyance rollers 115, first ejection rollers 117, and/or second ejection rollers 118 are respectively spaced in a width direction A2.

The top surface of the lower housing 101 forms a lower guide surface 101*a* of the conveyance path of a medium, and the bottom surface of the upper housing 102 forms an upper guide surface 102*a* of the conveyance path of a medium. The lower guide surface 101*a* and the upper guide surface 102*a* are examples of a guide surface of a medium.

The medium sensor 111 is located on the upstream side of the feed roller 112 and the separation roller 113. The medium sensor 111 includes a contact detection sensor and detects whether a medium is placed on the loading tray 103. The medium sensor 111 generates and outputs a medium signal the signal value of which varies between a state in which a medium is placed on the loading tray 103 and a state in which a medium is not placed. The medium sensor 111 is not limited to a contact detection sensor and any other sensor that can detect the presence of a medium, such as a light detection sensor, may be used as the medium sensor 111.

The feed roller 112 and the separation roller 113 are examples of a roller for separating a medium. The feed roller 112 is provided on the lower housing 101, sequentially feeds media placed on the loading tray 103 from the lower side. The separation roller 113 is a so-called brake roller or retard roller, is provided on the upper housing 102, is located to face the feed roller 112, and separates a medium by rotating in a direction opposite to the medium feeding direction. The feed roller 112 may be provided on the upper housing 102, and the separation roller 113 may be provided on the lower housing 101.

The first conveyance roller 114 and the second conveyance roller 115 are located on the downstream side of the feed roller 112 to face each other, and convey a medium fed by the feed roller 112 and the separation roller 113 to the imaging device 116.

The imaging device 116 is located on the downstream side of the first conveyance roller 114 and images a medium conveyed by the first conveyance roller 114. The imaging device 116 includes a first imaging device 116*a* and a second imaging device 116*b* that are located to face each other with the medium conveyance path in between. The first imaging device 116*a* includes a line sensor based on a unity-magnification optical system type contact image sensor (CIS) including complementary metal oxide semiconductor-(CMOS-) based imaging elements linearly arranged in a main scanning direction. The first imaging device 116*a* further includes lenses each forming an image on an imaging element, and an A/D converter amplifying and analog-digital (A/D) converting an electric signal output from the imaging element. The first imaging device 116*a* generates an input image by imaging the front side of a conveyed medium in accordance with control from a processing circuit to be described later and outputs the generated image.

Similarly, the second imaging device 116*b* includes a line sensor based on a unity-magnification optical system type CIS including CMOS-based imaging elements linearly arranged in the main scanning direction. The second imaging device 116*b* further includes lenses each forming an image on an imaging element, and an A/D converter amplifying and analog-digital (A/D) converting an electric signal output from the imaging element. The second imaging device 116*b* generates an input image by imaging the back side of a conveyed medium in accordance with control from the processing circuit to be described later and outputs the generated image.

Only one of the first imaging device 116*a* and the second imaging device 116*b* may be located and only one side of a medium may be read in the medium conveying apparatus 100. Further, a line sensor based on a unity-magnification optical system type CIS including charge coupled device-(CCD-) based imaging elements may be used in place of the line sensor based on a unity-magnification optical system type CIS including CMOS-based imaging elements. Further, a reduction optical system type line sensor including CMOS-based or CCD-based imaging elements may be used.

The first ejection roller 117 and the second ejection roller 118 are located on the downstream side of the imaging device 116 to face each other. The first ejection roller 117 and the second ejection roller 118 eject a medium conveyed by the first conveyance roller 114 and the second conveyance roller 115 and imaged by the imaging device 116 onto the ejection tray 105.

A medium placed on the loading tray 103 is conveyed between the lower guide surface 101*a* and the upper guide surface 101*b* toward the medium conveying direction A1 by the feed roller 112 rotating in a direction of an arrow A4 in FIG. 2, i.e., the medium conveying direction. The separation roller 113 rotates in a direction of an arrow A5, i.e., a direction opposite to the medium feeding direction at the time of medium conveying. When a plurality of media are placed on the loading tray 103, only a medium in contact with the feed roller 112 out of the medium placed on the loading tray 103 is separated by working of the feed roller 112 and the separation roller 113. Consequently, conveyance of a medium other than the separated medium is restricted (prevention of multi feed).

A medium is fed between the first conveyance roller 114 and the second conveyance roller 115 while being guided by the lower guide surface 101*a* and the upper guide surface 101*b*. The medium is fed between the first imaging device 116*a* and the second imaging device 116*b* by the first conveyance roller 114 and the second conveyance roller 115 rotating in directions of an arrow A6 and an arrow A7, respectively. The medium read by the imaging device 116 is ejected onto the ejection tray 105 by the first ejection roller 117 and the second ejection roller 118 rotating in directions of an arrow A8 and an arrow A9, respectively.

Figure 3B:
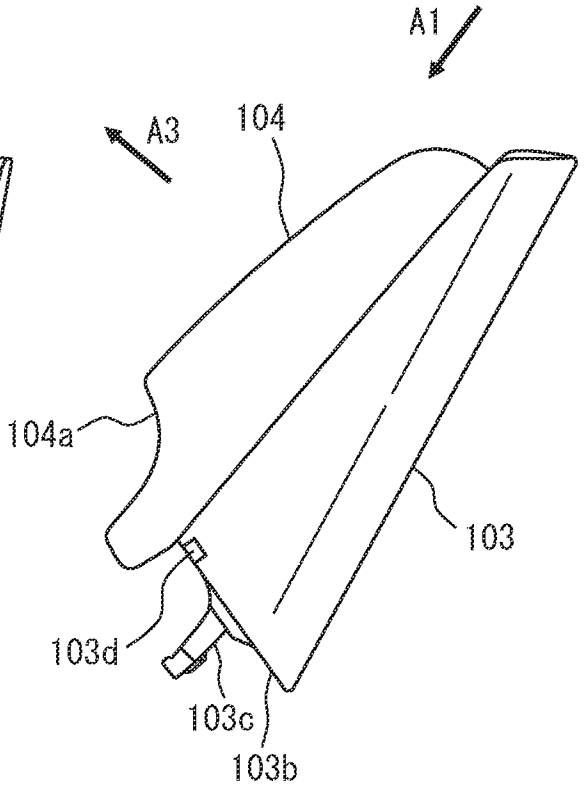
FIG. 3B is a schematic diagram for illustrating the loading tray.
Figure 3A:
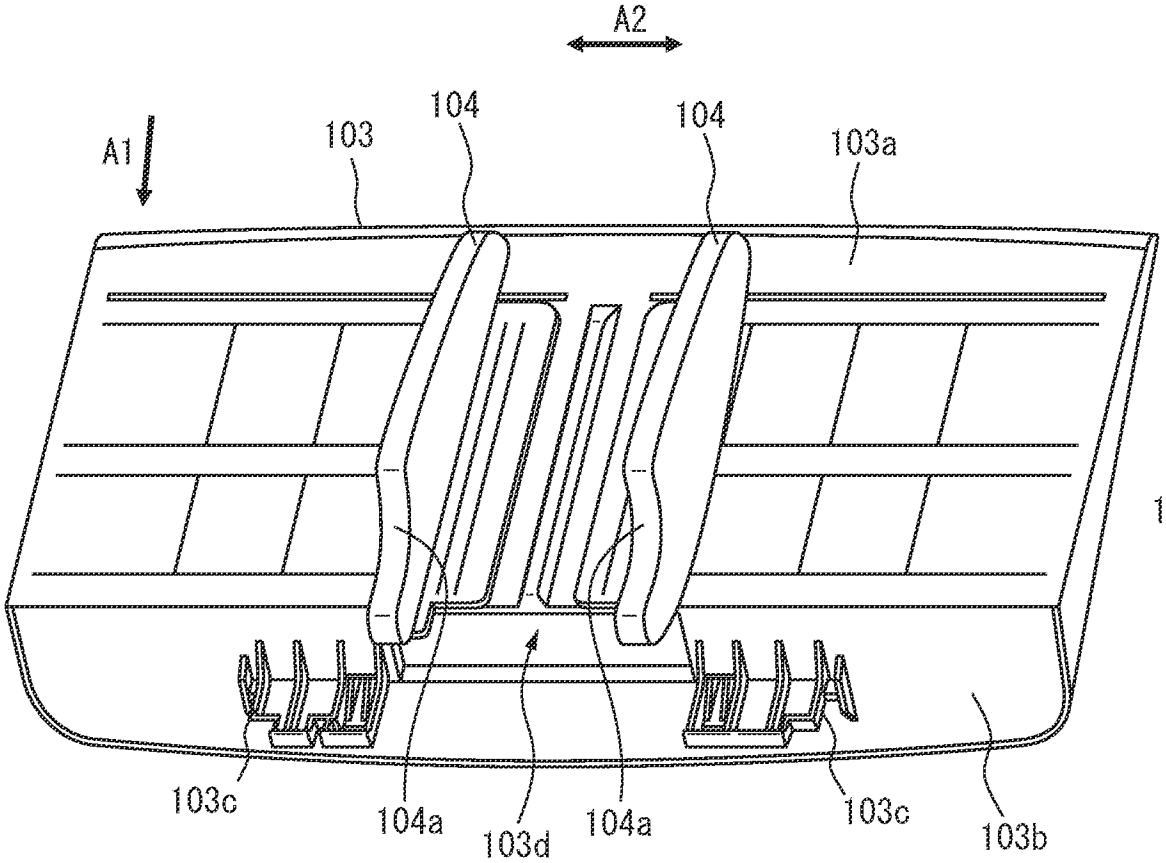
FIG. 3A is a schematic diagram for illustrating a loading tray.

FIGS. 3A and 3B are schematic diagrams for illustrating the loading tray. FIG. 3A is a perspective view of the loading tray 103 removed from the lower housing 101 viewed from above, and FIG. 3B is a side view of the loading tray 103 removed from the lower housing 101 viewed from the side.

As illustrated in FIGS. 3A and 3B, an engaging part 103*c* that can be engaged with an engaged part provided on the lower housing 101, which is described later, is provided on a downstream side 103*b* of the loading tray 103 facing the lower housing 101. In the example illustrated in FIG. 3A, two engaging parts 103*c* are spaced in the width direction A2. The number of engaging parts 103*c* may be one or more than two. Further, the loading tray 103 includes a recessed part 103*d* on the downstream side 103*b* facing the lower housing 101. The recessed part 103*d* is an example of the contact part. In the example illustrated in FIG. 3A, the recessed part 103*d* is provided between the two engaging parts 103*c*, i.e., in the central part in the width direction A2.

The side guide 104 is provided to protrude to the downstream side of the loading tray 103 in the medium conveying direction A1. Because the side guide 104 protrudes to the downstream side, the medium conveying apparatus 100 can suppress a tilt of a medium being conveyed and can suppress occurrence of a skew of the medium. A top surface part 104*a* of the side guide 104 is inclined on the downstream side so that an area closer to the lower end is positioned lower, i.e., gets closer to the placement surface 103*a*.

Figure 4:
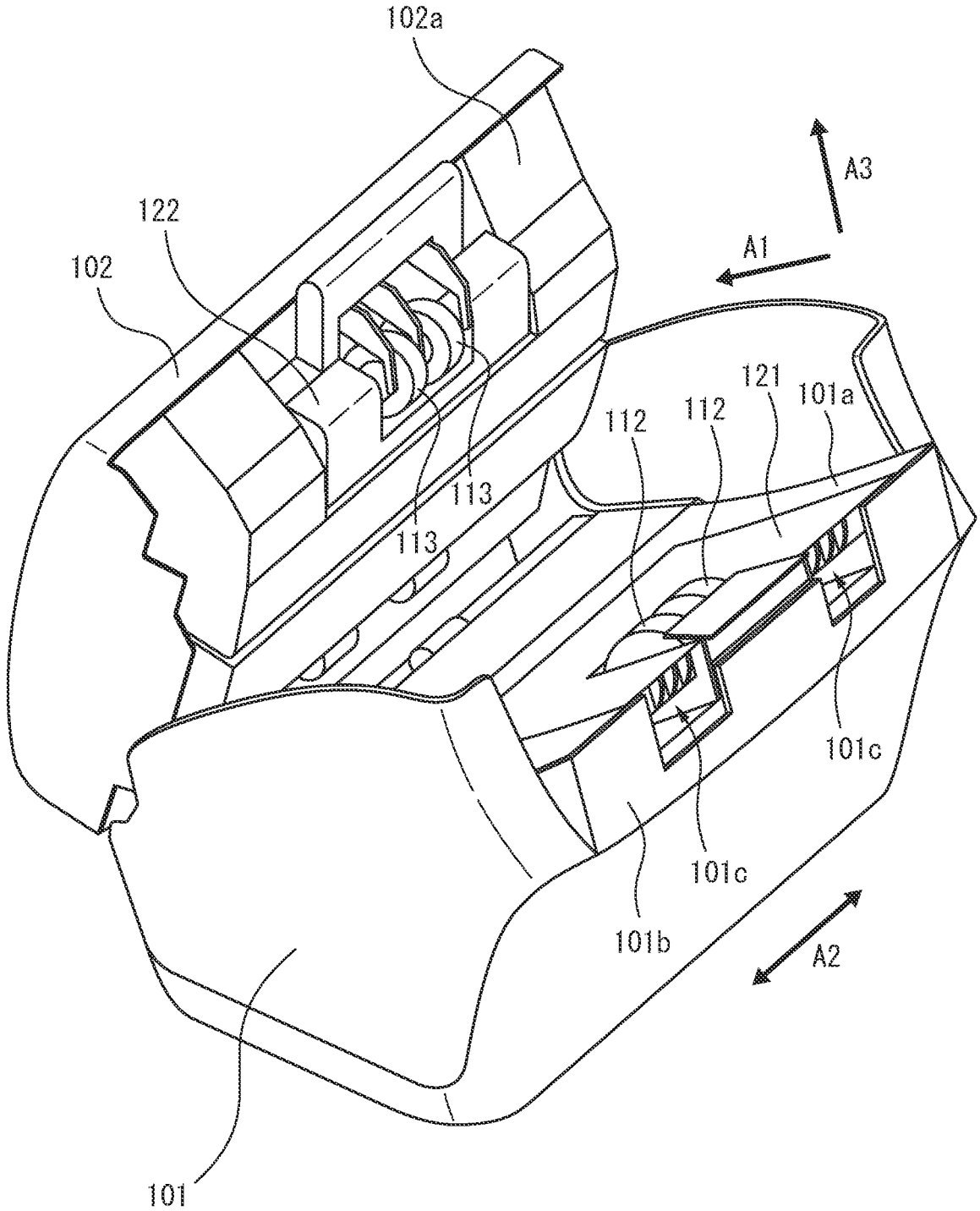
FIG. 4 is a schematic diagram for illustrating a lower housing and an upper housing.

FIG. 4 is a schematic diagram for illustrating the lower housing and the upper housing FIG. 4 is a perspective view of the lower housing 101 and the upper housing 102 in an open state viewed from above with the loading tray 103 being removed.

As illustrated in FIG. 4, an engaged part 101*c* that can be engaged with the engaging part 103*c* provided on the loading tray 103 is provided on an upstream side 101*b* of the lower housing 101 facing the loading tray 103. The number of engaged parts 101*c* is the same as the number of the engaging parts; and in the example illustrated in FIG. 4, two engaged parts 101*c*, which are engaged with the two engaging parts 103*c*, are spaced in the width direction A2.

The lower housing 101 is provided with a feed roller cover 121. The feed roller cover 121 is a cover for covering an area above the feed roller 112 and is provided to be openable and closable relative to the lower housing 101. The feed roller cover 121 is provided to be swingable between a closed position where the feed roller cover 121 is locked to the lower housing 101 and is closed relative to the lower housing 101 as illustrated in FIG. 4 and an open position where the feed roller cover 121 is not locked to the lower housing 101 and is open relative to the lower housing 101. The feed roller cover 121 covers the feed roller 112 and forms part of the lower guide surface 101*a* at the closed position. On the other hand, the feed roller cover 121 allows attachment and detachment of the feed roller 112 at the open position.

The upper housing 102 is provided with a separation roller cover 122. The separation roller cover 122 is a cover for covering an area below the separation roller 113 and is provided to be openable and closable relative to the upper housing 102. The separation roller cover 122 is provided to be swingable between a closed position where the separation roller cover 122 is locked to the upper housing 102 and is closed relative to the upper housing 102 as illustrated in FIG. 4 and an open position where the separation roller cover 122 is not locked to the upper housing 102 and is open relative to the upper housing 102. The separation roller cover 122 covers the separation roller 113 and forms part of the upper guide surface 102*a* at the closed position. On the other hand, the separation roller cover 122 allows attachment and detachment of the separation roller 113 at the open position.

Figure 5:
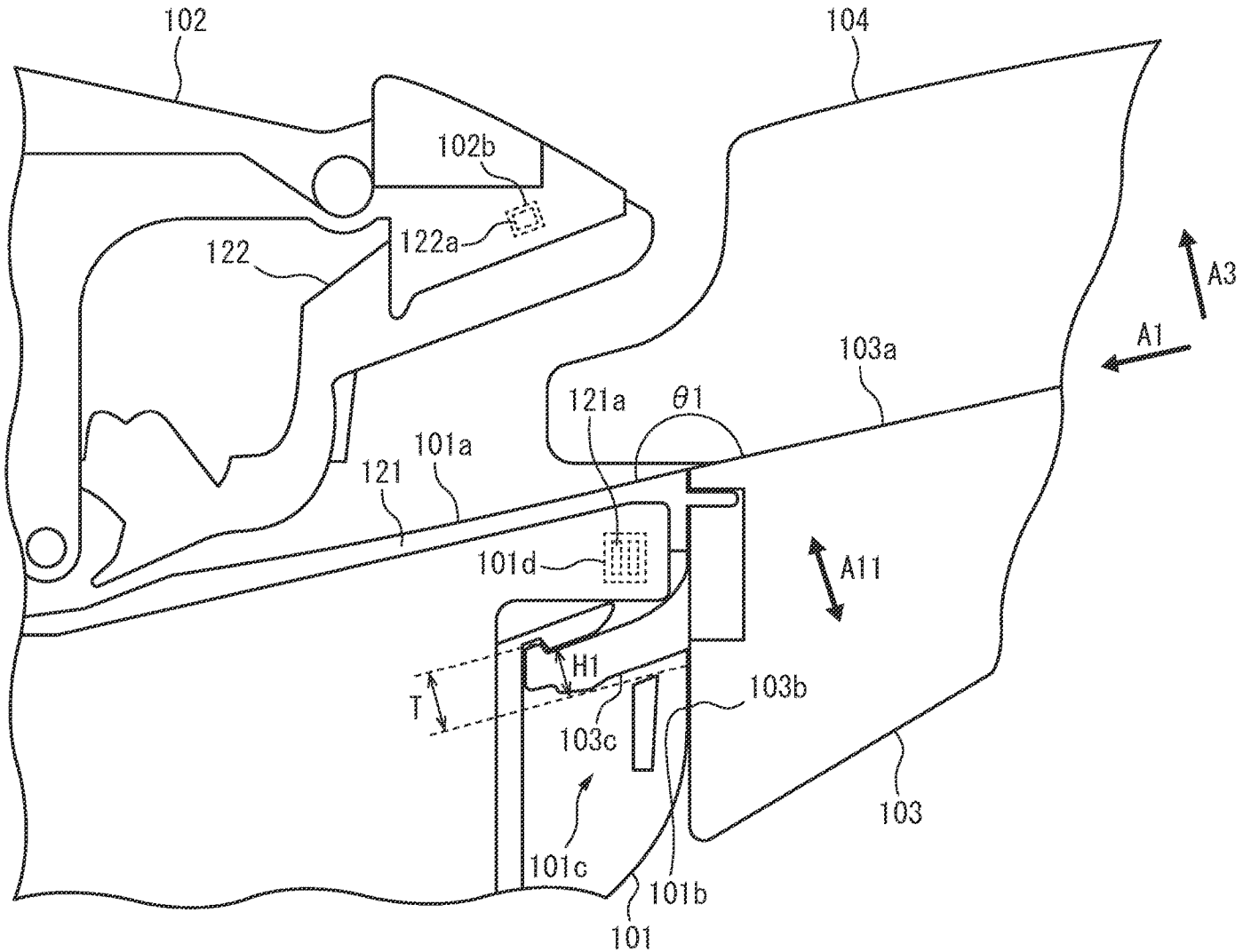
FIG. 5 is a schematic diagram for illustrating an engaging part and an engaged part.
Figure 6:
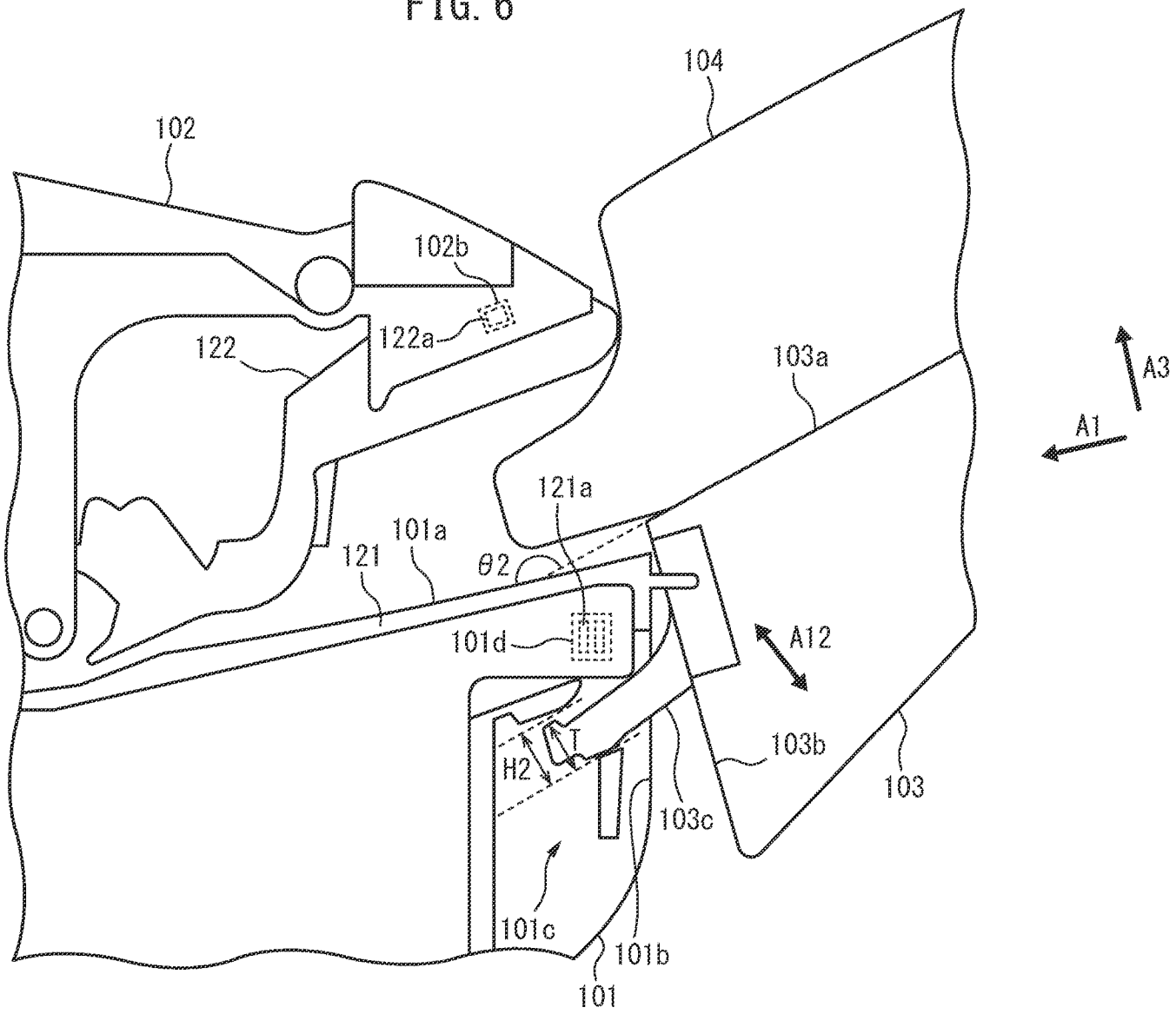
FIG. 6 is a schematic diagram for illustrating the engaging part and the engaged part.

FIG. 5 and FIG. 6 are schematic diagrams for illustrating a relationship between the engaging part 103*c* and the engaged part 101*c*. FIG. 5 and FIG. 6 are cross-sectional views of an area around the engaging part 103*c* and the engaged part 101*c* viewed from the side.

FIG. 5 illustrates a state in which each of the feed roller cover and the separation roller cover is located at the closed position and the loading tray is mounted and fixed to the lower housing A position where the loading tray 103 is fixed to the lower housing 101 and can load a medium as illustrated in FIG. 5 may be hereinafter referred to as a fixed position.

As illustrated in FIG. 5, a locking part 121*a* is provided on the side of the feed roller cover 121. On the other hand, a locked part 101*d* is provided at a position of the lower housing 101 facing the locking part 121*a* of the feed roller cover 121 located at the closed position. The locking part 121*a* includes a protruding part, and the locked part 101*d* includes a recessed part. The locked part 101*d* may include a protruding part, and the locking part 121*a* may include a recessed part. By fitting the locking part 121*a* into the locked part 101*d*, the feed roller cover 121 is locked to the lower housing 101 and is fixed at the closed position.

A locking part 122*a* is provided on the side of the separation roller cover 122. On the other hand, a locked part 102*b* is provided on the upper housing 102 at a position facing the locking part 122*a* of the separation roller cover 122 located at the closed position. The locking part 122*a* includes a protruding part, and the locked part 102*b* includes a recessed part. The locked part 102*b* may include a protruding part, and the locking part 122*a* may include a recessed part. By fitting the locking part 122*a* into the locked part 102*b*, the separation roller cover 122 is locked to the upper housing 102 and is fixed at the closed position.

The engaged part 101*c* provided on the lower housing 101 includes an entry hole formed to open toward the upstream side and upward. On the other hand, the engaging part 103*c* provided on the loading tray 103 is provided to protrude toward the downstream side and downward. By inserting the engaging part 103*c* into the engaged part 101*c* from the entry hole and fitting into the engaged part 101*c*, the loading tray 103 is supported by and is fixed to the lower housing 101.

The placement surface 103*a* of the loading tray 103 is located to form a first angle θ1 with the lower guide surface 101*a* of the lower housing 101 when the loading tray 103 is located at the fixed position and is fixed to the lower housing 101. In other words, the first angle θ1 is an angle formed by the lower guide surface 101*a* and the placement surface 103*a* when the loading tray 103 is located at the fixed position. For example, the first angle θ1 is 180°. In other words, the placement surface 103*a* and the lower guide surface 101*a* are provided to be flush with each other when the loading tray 103 is fixed to the lower housing 101. Consequently, the medium conveying apparatus 100 can smoothly convey a medium along the placement surface 103*a* and the lower guide surface 101*a* and can improve medium conveyance performance.

The first angle θ1 is not limited to 180° and is set to an angle in a range allowing conveyance of a medium (such as a range of greater than or equal to 150° and less than or equal to 180°).

The size H1 of the entry hole to the engaged part 101*c* is less than the thickness T of the engaging part 103*c* in a thickness direction A11 perpendicular to an extending direction of the engaging part 103*c* when the placement surface 103*a* and the lower guide surface 101*a* forms the first angle θ1. Therefore, the engaging part 103*c* is caught by the entry hole to the engaged part 101*c* and cannot enter inside the engaged part 101*c*. Thus, when the loading tray 103 is mounted to the lower housing 101, the engaged part 101*c* is formed to restrict entry of the engaging part 103*c* when the placement surface 103*a* and the lower guide surface 101*a* forms the first angle θ1, i.e., when the placement surface 103*a* has the same tilt as when placed at the fixed position.

FIG. 6 illustrates a state of the loading tray being mounted to the lower housing. In the state illustrated in FIG. 6, the loading tray 103 is tilted relative to the fixed position. A position inclined relative to the fixed position for mounting the loading tray 103 to the lower housing 101 as illustrated in FIG. 6 may be hereinafter referred to as an inclined position. Thus, the loading tray 103 is provided to be attachable and detachable relative to the lower housing 101 and be movable between the fixed position and the inclined position. When the loading tray 103 is located at the inclined position, the placement surface 103*a* and the lower guide surface 101*a* form a second angle θ2 different from the first angle θ1 formed by the placement surface 103*a* and the lower guide surface 101*a* when the loading tray 103 is fixed to the lower housing 101. In other words, the second angle θ2 is an angle formed by the lower guide surface 101*a* and the placement surface 103*a* when the loading tray 103 is located at the inclined position. The second angle θ2 is less than the first angle θ1 and, for example, is set in a range of 120° to 150°.

The second angle θ2 is set to be less than the first angle θ1, and therefore when the loading tray 103 moves (swings) from the inclined position to the fixed position, the angle of the placement surface 103*a* approaches horizontal, and the downstream side 103*b* of the loading tray 103 approaches the upstream side 101*b* of the lower housing 101. Then, when the loading tray 103 is located at the fixed position, the downstream side 103*b* of the loading tray 103 comes into contact with the upstream side 101*b* of the lower housing 101, and the loading tray 103 is stably supported by the lower housing 101.

As described above, the entry hole of the engaged part 101*c* is formed to open toward the upstream side and upward, and the engaging part 103*c*, on the other hand, is provided to protrude toward the downstream side and downward. Therefore, the Euclidian distance between facing edges of the entry hole is sufficiently greater than the distance between facing edges of the entry hole in the height direction A3. In particular, as illustrated in FIG. 6, the size H2 of the entry hole of the lower housing 101 to the engaged part 101*c* in a thickness direction A12 perpendicular to the extending direction of the engaging part 103*c* when the placement surface 103*a* and the lower guide surface 101*a* form the second angle θ2 is greater than or equal to the thickness T of the engaging part 103*c*. Therefore, when the placement surface 103*a* and the lower guide surface 101*a* form the second angle θ2, the engaging part 103*c* can enter inside the engaged part 101*c* through the entry hole to the engaged part 101*c*.

Thus, the engaged part 101*c* is formed to allow entry of the engaging part 103*c* when the placement surface 103*a* and the lower guide surface 101*a* form the second angle θ2 different from the first angle θ1, i.e., the placement surface 103*a* is located at the inclined position at the time when the loading tray 103 is mounted to the lower housing 101.

In other words, the entry hole of the lower housing 101 to the engaged part 101*c* has a shape allowing entry of the engaging part 103*c* when the placement surface 103*a* and the lower guide surface 101*a* form the second angle θ2. On the other hand, as illustrated in FIG. 5, the entry hole to the engaged part 101*c* of the lower housing 101 has a shape prohibiting entry of the engaging part 103*c* when the placement surface 103*a* and the lower guide surface 101*a* form an angle (including the first angle θ1) out of a predetermined range relative to the second angle θ2. Consequently, the medium conveying apparatus 100 can allow or restrict entry of the engaging part 103*c* into the engaged part 101*c* with a simple structure and can satisfactorily set the loading tray 103 while suppressing the increase in design man-hours and manufacture man-hours of the medium conveying apparatus 100.

Figure 7:
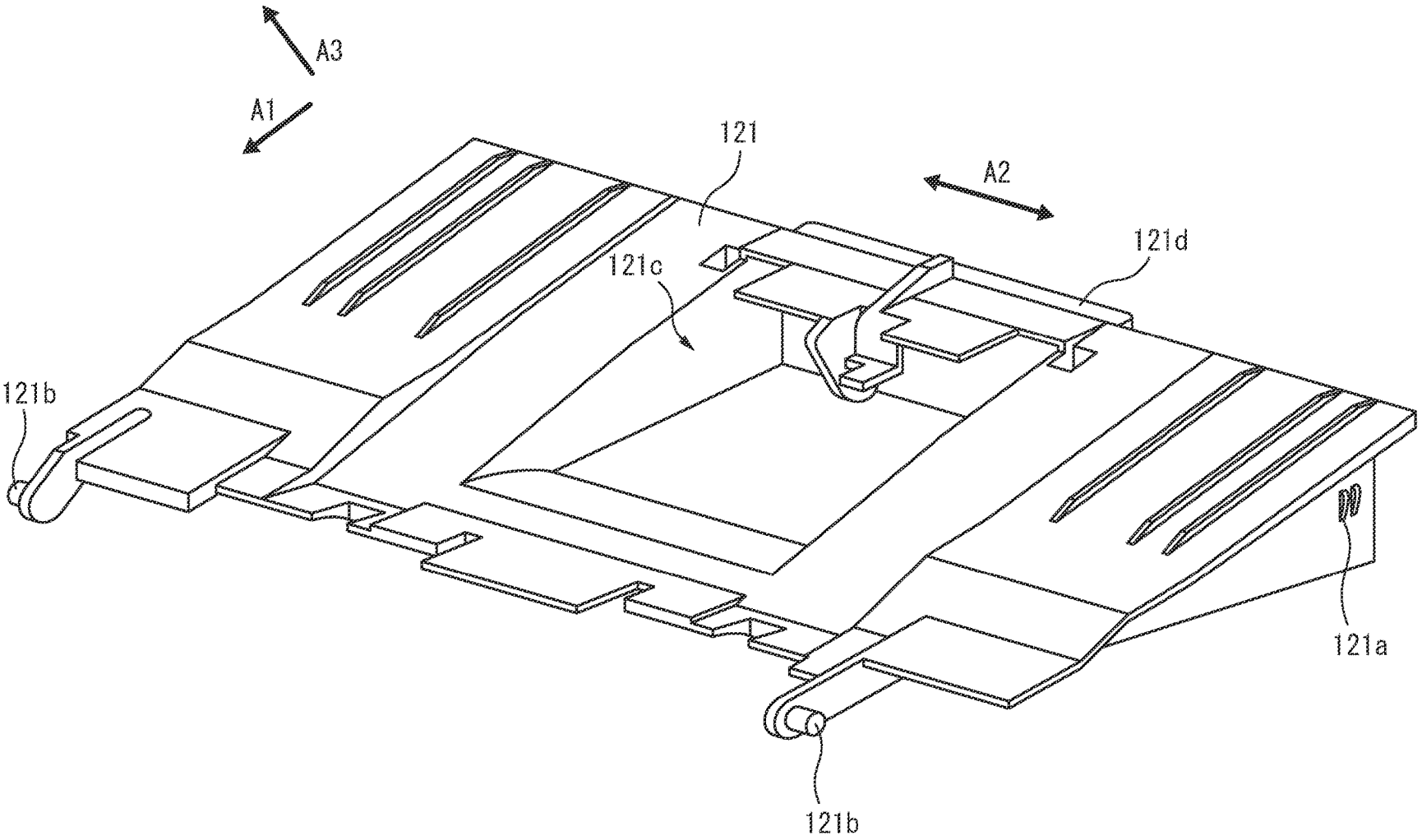
FIG. 7 is a schematic diagram for illustrating a feed roller cover.

FIG. 7 is a schematic diagram for illustrating the feed roller cover. FIG. 7 is a perspective view of the feed roller cover 121 removed from the lower housing 101 viewed from above.

As illustrated in FIG. 7, the feed roller cover 121 includes a shaft part 121*b*, an opening 121*c*, and a protruding part 121*d* in addition to the locking part 121*a*.

The shaft part 121*b* is provided at a downstream side edge of the feed roller cover 121 in the medium conveying direction A1 and is rotatably (swing ably) mounted to the lower housing 101. In other words, the feed roller cover 121 is provided to be swingable around the shaft part 121*b* provided at the downstream side edge in the medium conveying direction A1 relative to the lower housing 101.

The opening 121*c* is provided at the central part of the feed roller cover 121 in the width direction A2, and the feed roller 112 is located in the opening 121*c*.

The protruding part 121*d* is provided at an upstream side edge of the feed roller cover 121 to protrude toward the upstream side.

Figure 8A:
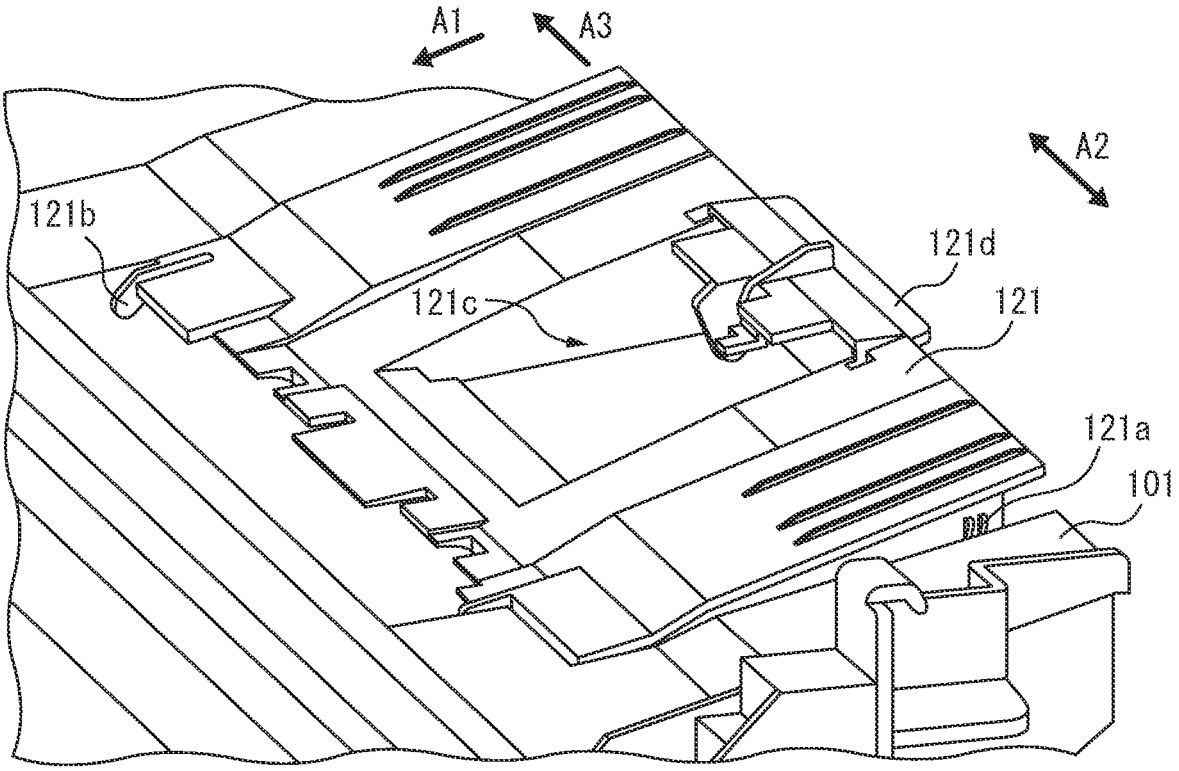
FIG. 8A is a schematic diagram for illustrating the feed roller cover.
Figure 8B:
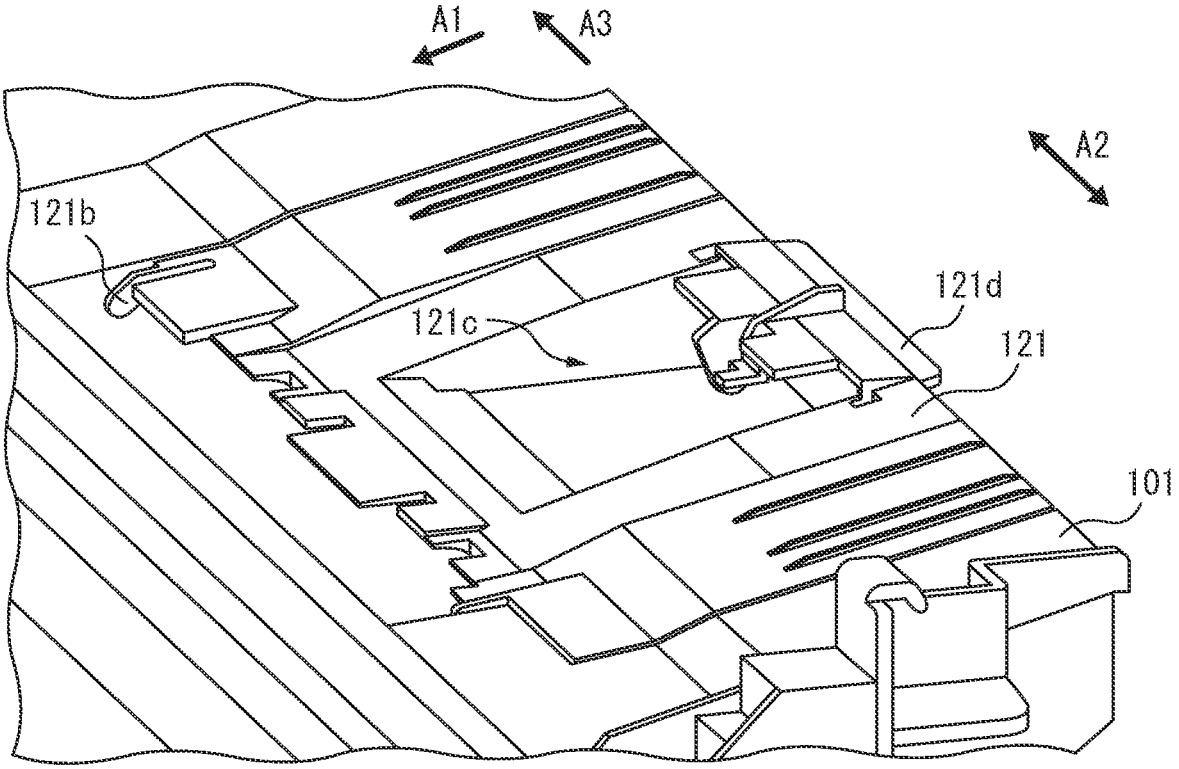
FIG. 8B is a schematic diagram for illustrating the feed roller cover.

FIGS. 8A and 8B are schematic diagrams for illustrating the feed roller cover mounted to the lower housing. FIGS. 8A and 8B are perspective views of an area around the feed roller cover 121 mounted to the lower housing 101 viewed from above. FIG. 8A illustrates the feed roller cover 121 in an open state, and FIG. 8B illustrates the feed roller cover 121 in a closed state. In FIGS. 8A and 8B, the feed roller 112 is not illustrated for enhanced visual recognizability.

As illustrated in FIG. 8A, the feed roller cover 121 is mounted to the lower housing 101 by the shaft part 121*b* mounted to the lower housing 101. In the state illustrated in FIG. 8A, the locking part 121*a* is not fit into the locked part 101*d*, and the feed roller cover 121 floats relative to the lower housing 101. Thus, the open position includes not only a position where an upstream part of the feed roller cover 121 is not in contact with the lower housing 101 but also a position in a so-called semi-locked state where the upstream part of the feed roller cover 121 is in contact with the lower housing 101 but not being locked to the lower housing 101.

When a user pushes down the feed roller cover 121 from the state illustrated in FIG. 8A, the locking part 121*a* is fit into the locked part 101*d*, and the feed roller cover 121 is locked to the lower housing 101, as illustrated in FIG. 8B.

Figure 9A:
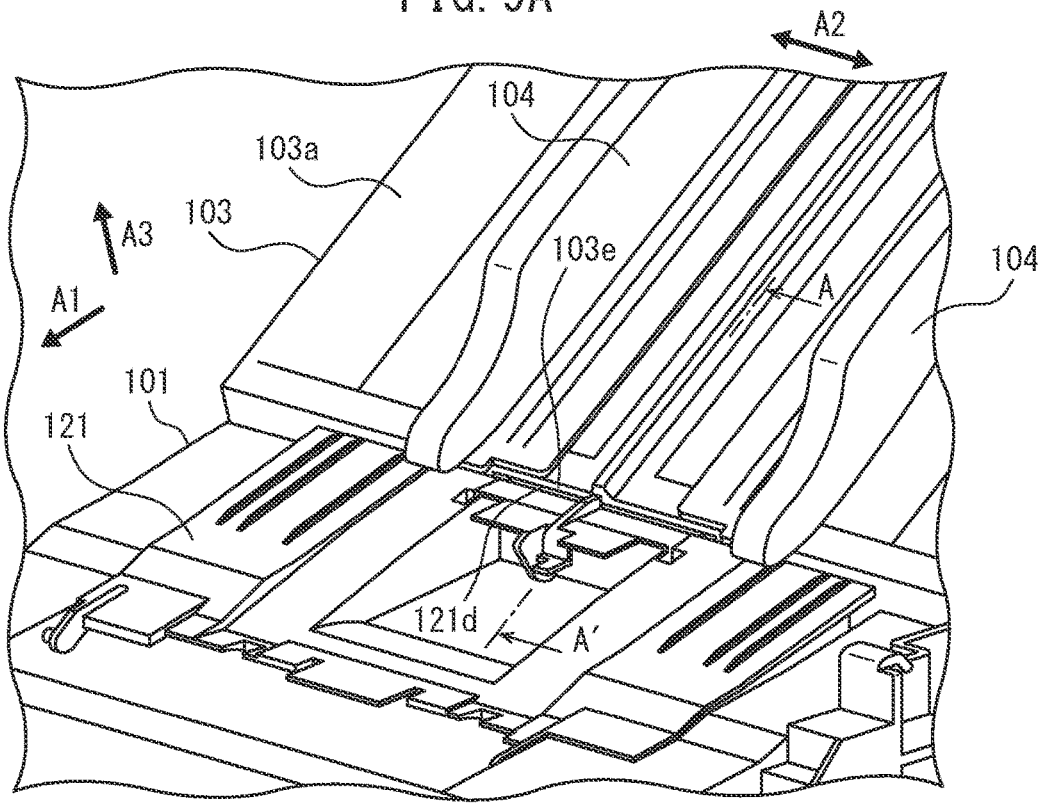
FIG. 9A is a schematic diagram for illustrating motion of the feed roller cover.
Figure 9B:
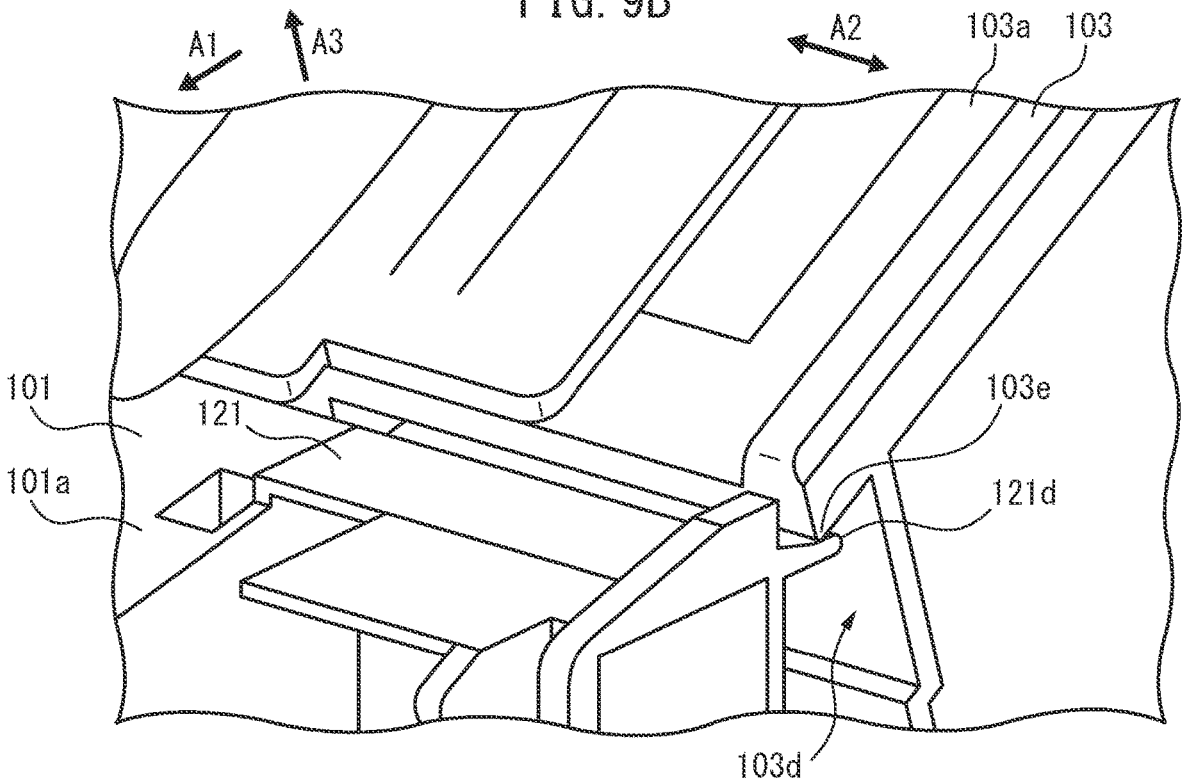
FIG. 9B is a schematic diagram for illustrating the motion of the feed roller cover.
Figure 10A:
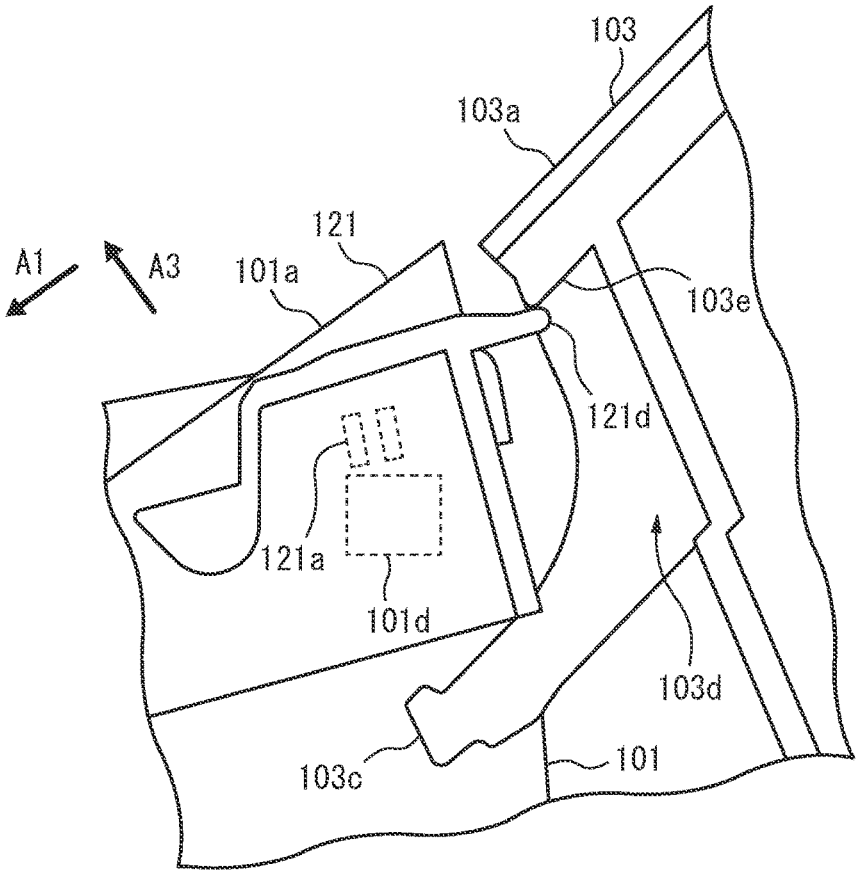
FIG. 10A is a schematic diagram for illustrating the motion of the feed roller cover.

FIGS. 9A and 9B and FIGS. 10A and 10B are schematic diagrams for illustrating the motion of the feed roller cover when the loading tray is mounted to the lower housing with the feed roller cover located at the open position. FIG. 9A is a schematic diagram viewed from diagonally above when the loading tray 103 is mounted to the lower housing 101 with the feed roller cover 121 located at the open position. FIG. 9B is a schematic diagram of an A-A' line section in FIG. 9A viewed from diagonally above. FIG. 10A is a schematic diagram of the A-A' line section in FIG. 9A viewed from the side.

As illustrated in FIGS. 9A and 9B and FIG. 10A, when the feed roller cover 121 is located at the open position, the locking part 121*a* is not fit into the locked part 101*d*, and the feed roller cover 121 floats relative to the lower housing 101. As described above, the loading tray 103 is located at the inclined position when being mounted to the lower housing 101. When the loading tray 103 is mounted to the lower housing 101, an upper edge 103*e* of the recessed part 103*d* provided on the downstream side 103*b* of the loading tray 103 located at the inclined position comes into contact with the protruding part 121*d* of the feed roller cover 121.

Figure 10B:
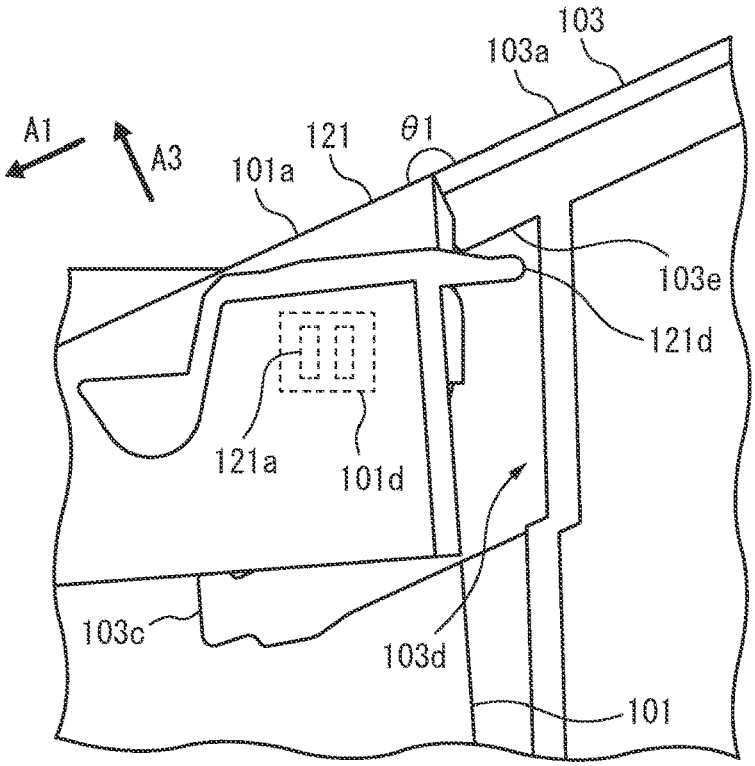
FIG. 10B is a schematic diagram for illustrating the motion of the feed roller cover.

FIG. 10B is a schematic diagram illustrating a situation in which the loading tray 103 moves from the inclined position illustrated in FIG. 10A to the fixed position.

As illustrated in FIG. 10B, by pushing down the loading tray 103 from the inclined position toward the fixed position, the upper edge 103*e* of the recessed part 103*d* of the loading tray 103 pushes down the protruding part 121*d* of the feed roller cover 121. Consequently, the locking part 121*a* is fit into the locked part 101*d*, and the feed roller cover 121 is locked to the lower housing 101 and is fixed at the closed position. Thus, when the loading tray 103 moves from the inclined position to the fixed position with the feed roller cover 121 located at the open position, the recessed part 103*d* of the loading tray 103 comes into contact with the feed roller cover 121 and pushes the feed roller cover 121 toward the closed position.

When cleaning or replacing the feed roller 112 or removing a medium caught in the feed roller cover 121, a user normally opens the feed roller cover 121 after removing the loading tray 103 from the lower housing 101 in order to avoid the loading tray 103 being obstructive. Then, after cleaning or replacing the feed roller 112 or removing a medium caught in the feed roller cover 121, the user closes the feed roller cover 121. In the medium conveying apparatus 100, when the loading tray 103 is mounted with the feed roller cover 121 located at the open position, the feed roller cover 121 is pushed into the closed position by the loading tray 103. Therefore, in the medium conveying apparatus 100, the feed roller cover 121 is reliably closed by the loading tray 103 mounted to the lower housing 101 even when the user neglects to close the feed roller cover 121 or fails to close the feed roller cover 121. Accordingly, the medium conveying apparatus 100 can suppress occurrence of a conveyance abnormality, such as jamming or skewing of a medium, due to the medium being conveyed while the feed roller cover 121 is in the open state.

In the medium conveying apparatus 100, the recessed part 103*d* of the loading tray 103 is provided at a downstream side edge of the loading tray 103 in the medium conveying direction A1 to be in contact with the protruding part 121*d* provided at the upstream side edge of the feed roller cover 121 in the medium conveying direction A1. Consequently, the medium conveying apparatus 100 can close the feed roller cover 121 provided at the upstream side edge of the lower housing 101 by using the loading tray 103 mounted to the upstream side edge of the lower housing 101. The medium conveying apparatus 100 can close the feed roller cover 121 being not fully closed by using the loading tray 103 without using a special part. Accordingly, the medium conveying apparatus 100 can suitably set the feed roller cover 121 while suppressing the increase in the apparatus cost and the apparatus size.

In the medium conveying apparatus 100, the recessed part 103*d* of the loading tray 103 is provided to push the feed roller cover 121 located at the open position downward. Consequently, the medium conveying apparatus 100 can close the feed roller cover 121 covering an area above the feed roller 112 by using the loading tray 103 mounted to the lower housing 101 by being pushed down from the inclined position to the fixed position. Therefore, the medium conveying apparatus 100 can close the feed roller cover 121 being not fully closed by using the loading tray 103 without using a special part. Accordingly, the medium conveying apparatus 100 can suitably set the feed roller cover 121 while suppressing the increase in the apparatus cost and the apparatus size.

Figure 11:
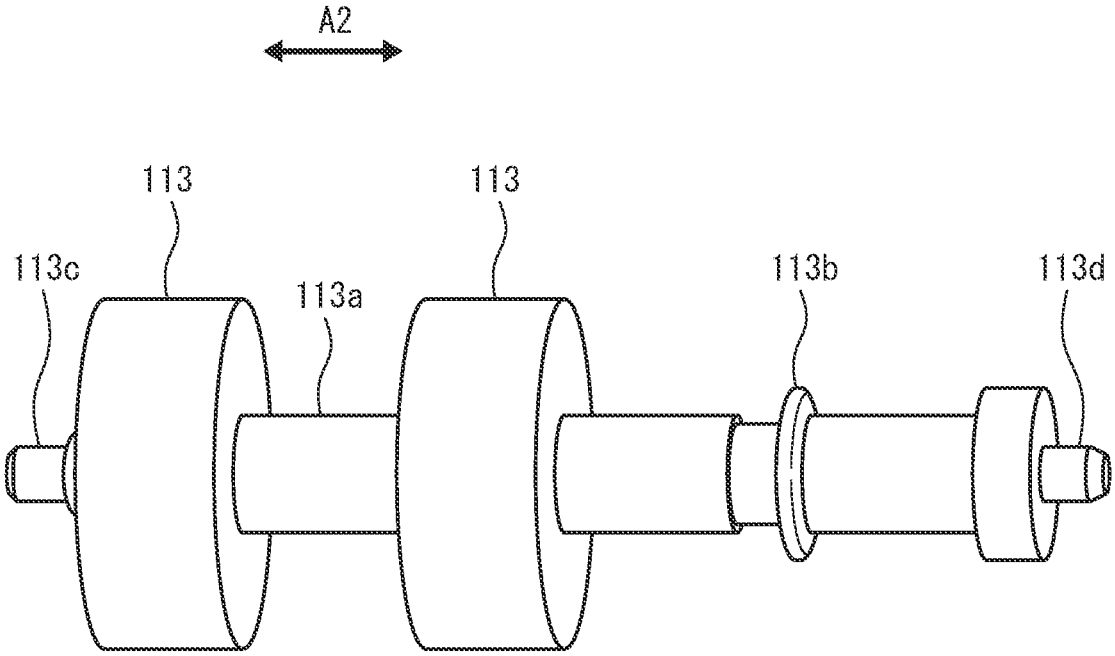
FIG. 11 is a schematic diagram for illustrating a separation roller.

FIG. 11 is a schematic diagram for illustrating the separation roller. FIG. 11 is a schematic diagram illustrating the separation roller 113 removed from the upper housing 102.

As illustrated in FIG. 11, the separation roller 113 is provided on a shaft 113*a* being a rotation axis. A protruding part 113*b* extending along a circumferential direction is provided at a predetermined position in an extending direction of the shaft 113*a*. Further, each of a first end 113*c* being one end of the shaft 113*a* and a second end 113*d* being the other end is chamfered. The second end 113*d* is an example of an end. By the first end 113*c* and the second end 113*d* being supported by the upper housing 102, the separation roller 113 is rotatably supported by the upper housing 102. The separation roller 113 is attachably and detachably provided on the upper housing 102.

Figure 12A:
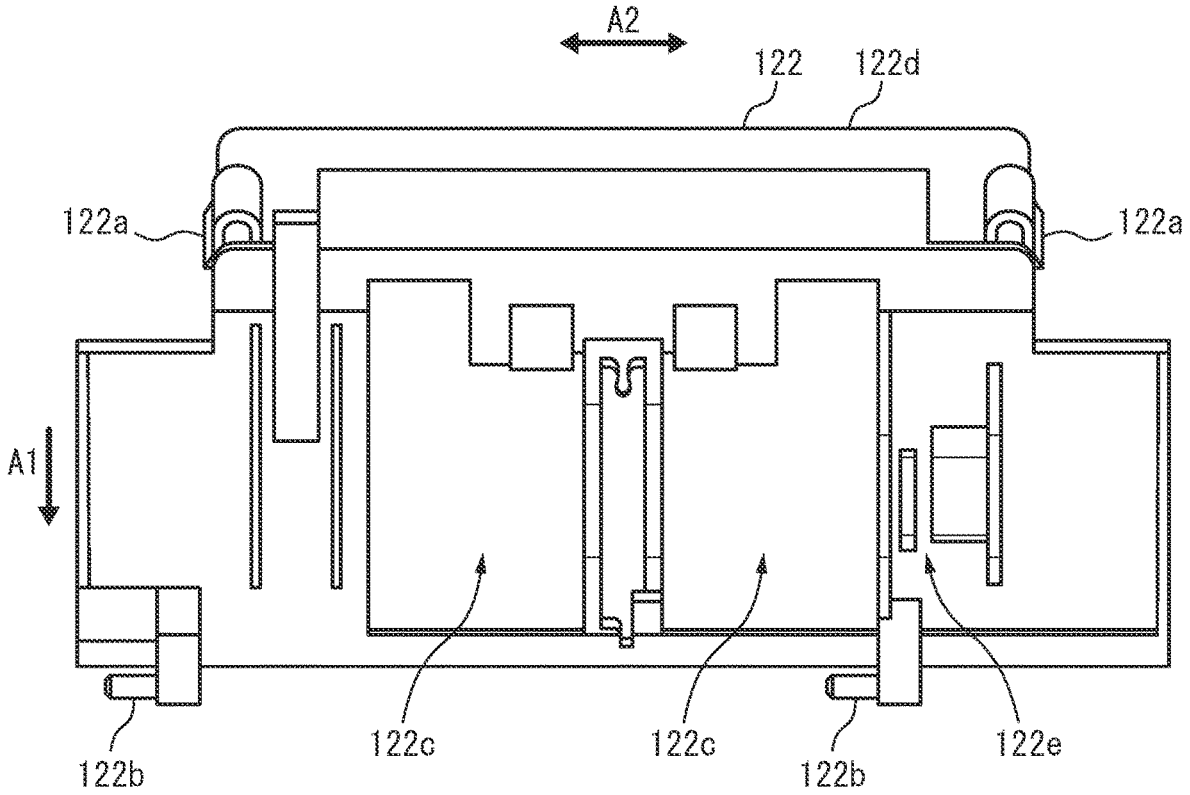
FIG. 12A is a schematic diagram for illustrating a separation roller cover.
Figure 12B:
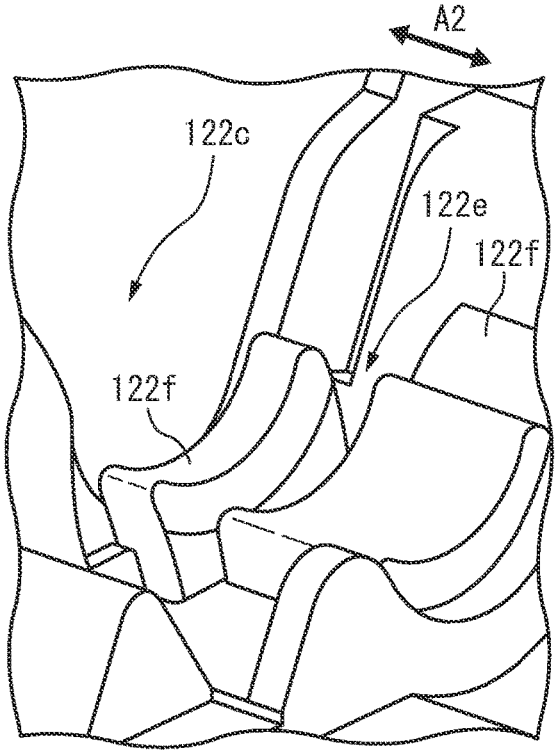
FIG. 12B is a schematic diagram for illustrating the separation roller cover.

FIGS. 12A and 12B are schematic diagrams for illustrating the separation roller cover. FIG. 12A is a schematic diagram of the separation roller cover 122 removed from the upper housing 102 viewed from inside (viewed from the upper housing 102 side).

As illustrated in FIG. 12A, the separation roller cover 122 includes a shaft part 122*b*, an opening 122*c*, and a bottom surface part 122*d* in addition to the locking part 122*a*.

The shaft part 122*b* is provided at a downstream side edge of the separation roller cover 122 in the medium conveying direction A1 and is rotatably (swingably) mounted to the upper housing 102. In other words, the separation roller cover 122 is provided to be swingable relative to the upper housing 102 around the shaft part 122*b* provided at the downstream side edge in the medium conveying direction A1.

The opening 122*c* is provided at the central part of the separation roller cover 122 in the width direction A2, and the separation roller 113 is located in the opening 122*c*. A recessed part 122*e* is provided outside the opening 122*c* in the width direction A2.

The bottom surface part 122*d* is a surface facing the medium conveyance path and is a surface forming part of the upper guide surface 102*a*.

FIG. 12B is an enlarged perspective view displaying an area around the recessed part 122*e*.

As illustrated in FIG. 12B, a curved surface 122*f* for locating the shaft 113*a* of the separation roller 113 is formed in the separation roller cover 122, and the recessed part 122*e* is formed on part of the curved surface 122*f*.

Figure 13:
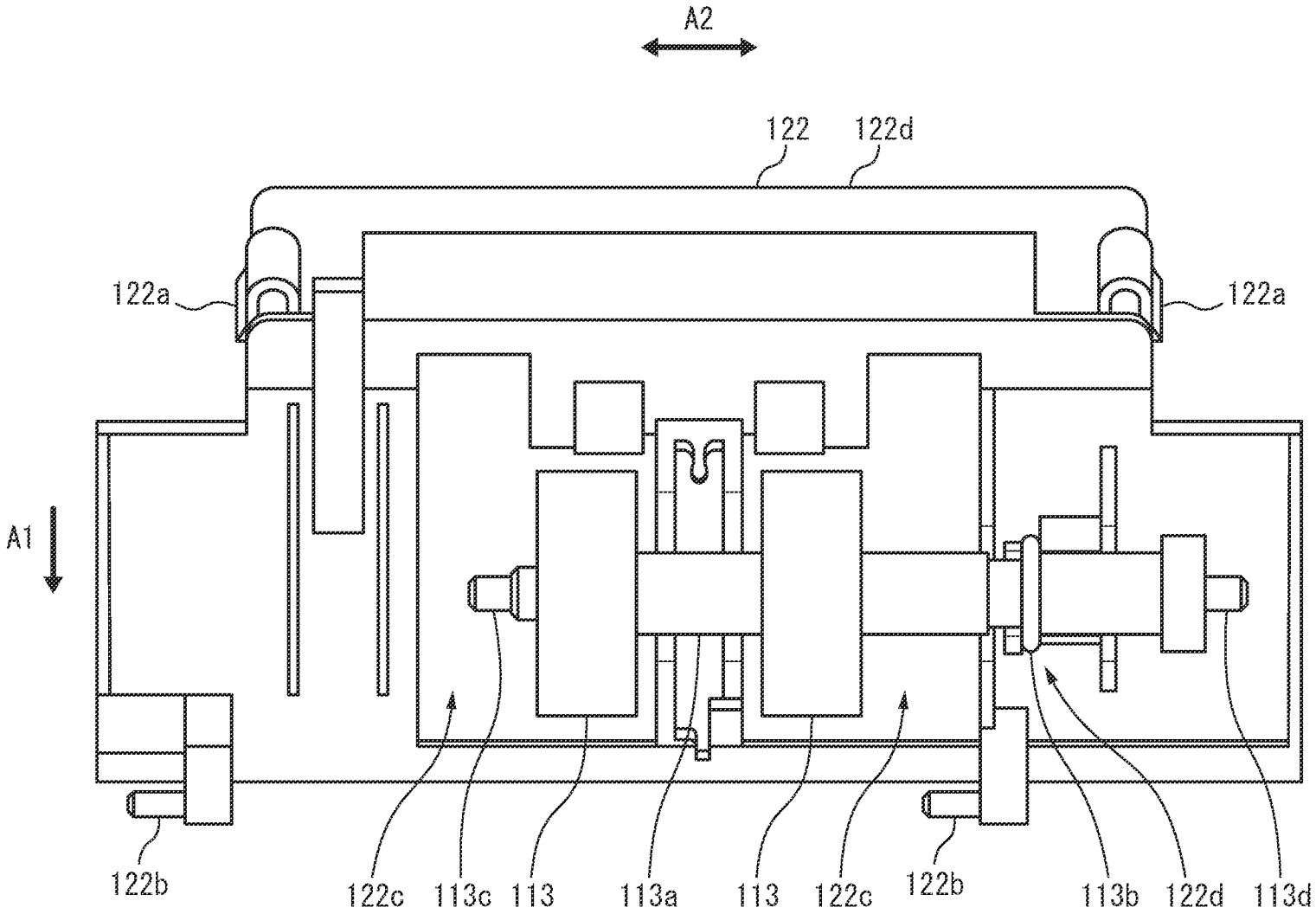
FIG. 13 is a schematic diagram for illustrating the separation roller cover.

FIG. 13 is a schematic diagram for illustrating the separation roller cover when the separation roller is located. FIG. 13 is a schematic diagram of the separation roller cover 122 viewed from inside (viewed from the upper housing 102 side) when the separation roller 113 is located.

As illustrated in FIG. 13, by locating the protruding part 113*b* of the shaft 113*a* of the separation roller 113 to engage with the recessed part 122*e*, the separation roller 113 is located to face the opening 122*c* and is positioned relative to the separation roller cover 122.

Figure 14A:
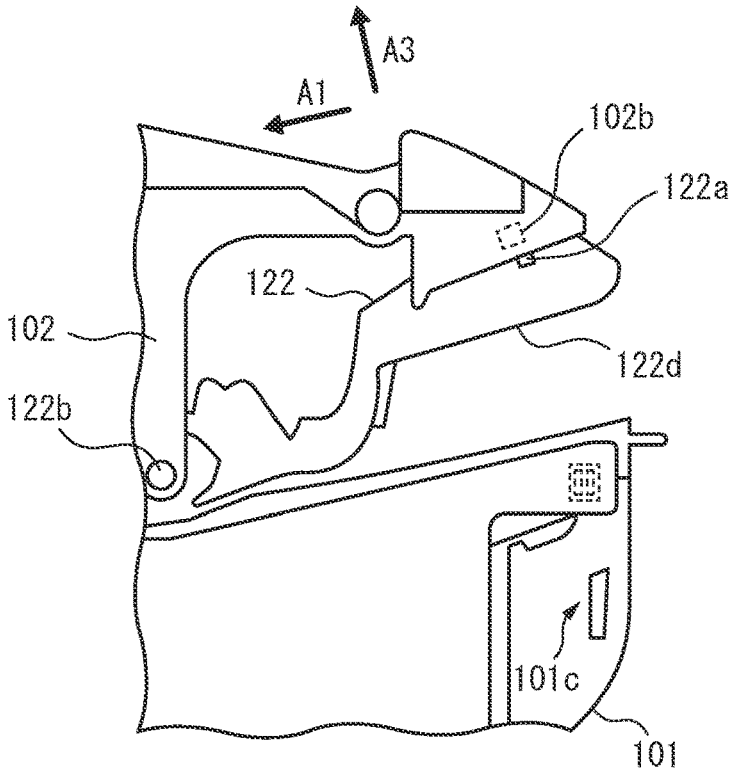
FIG. 14A is a schematic diagram for illustrating the separation roller cover.
Figure 14B:
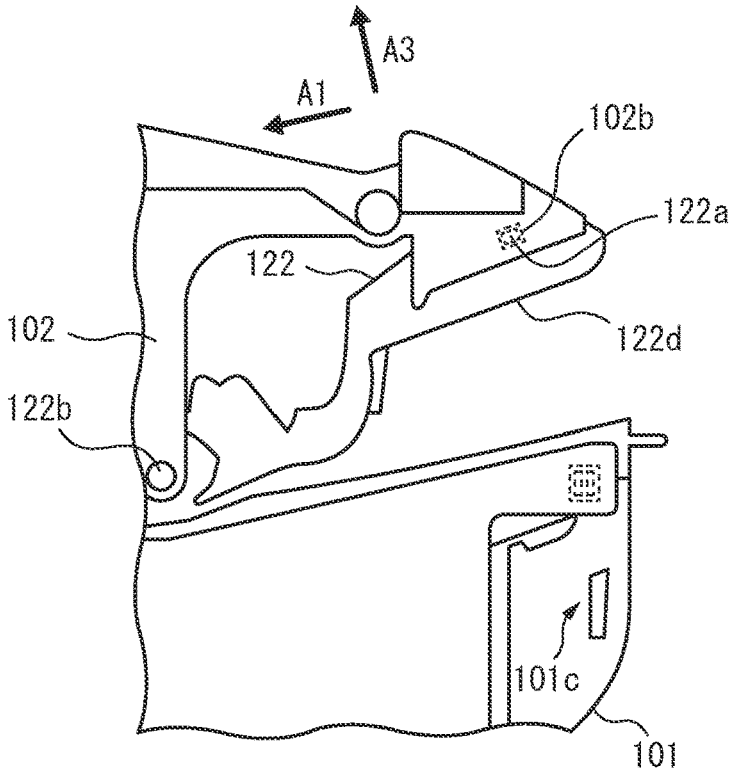
FIG. 14B is a schematic diagram for illustrating the separation roller cover.

FIGS. 14A and 14B are schematic diagrams for illustrating the separation roller cover mounted to the upper housing. FIGS. 14A and 14B are schematic diagrams of an area around the separation roller cover 122 mounted to the upper housing 102 viewed from the side. FIG. 14A illustrates the separation roller cover 122 in the open state, and FIG. 14B illustrates the separation roller cover 122 in the closed state. In FIGS. 14A and 14B, the separation roller 113 is not illustrated for enhanced visual recognizability.

As illustrated in FIG. 14A, by mounting the shaft part 122*b* to the upper housing 102, the separation roller cover 122 is mounted to the upper housing 102. In the state illustrated in FIG. 14A, the locking part 122*a* is not fit into the locked part 102*b*, and the separation roller cover 122 floats relative to the upper housing 102. Thus, the open position includes not only a position when the upstream part of the separation roller cover 122 is not in contact with the upper housing 102 but also a position in a so-called semi-locked state where the upstream part of the separation roller cover 122 is in contact with the upper housing 102, but not being locked to the upper housing 102.

When a user pushes up the separation roller cover 122 from the state illustrated in FIG. 14A, the locking part 122*a* is fit into the locked part 102*b*, and the separation roller cover 122 is locked to the upper housing 102, as illustrated in FIG. 14B.

Figure 15A:
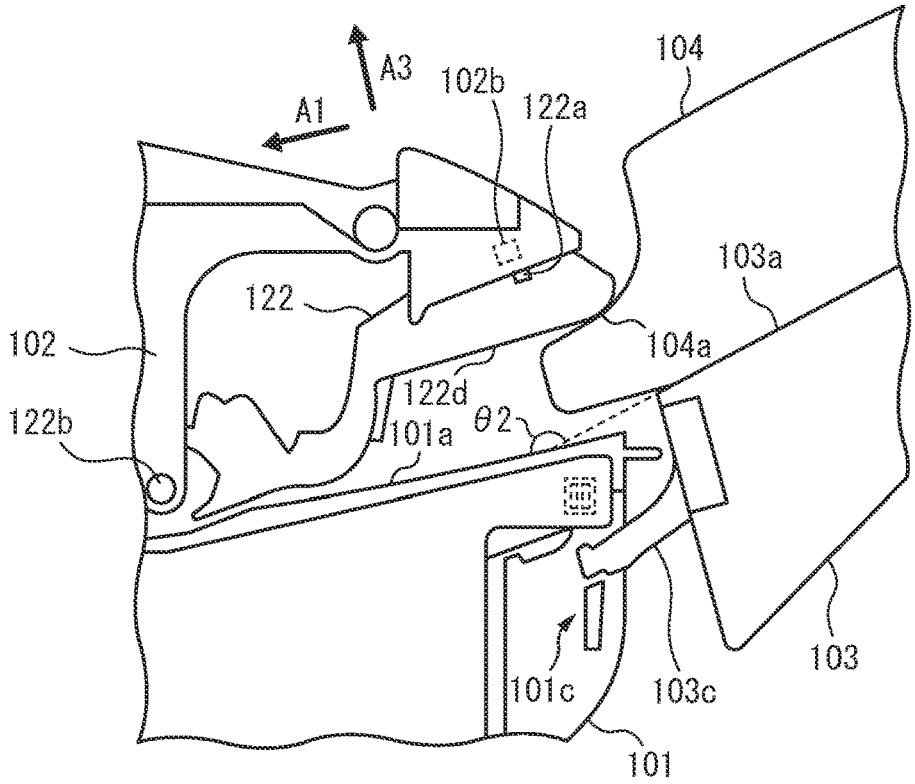
FIG. 15A is a schematic diagram for illustrating motion of the separation roller cover.
Figure 15B:
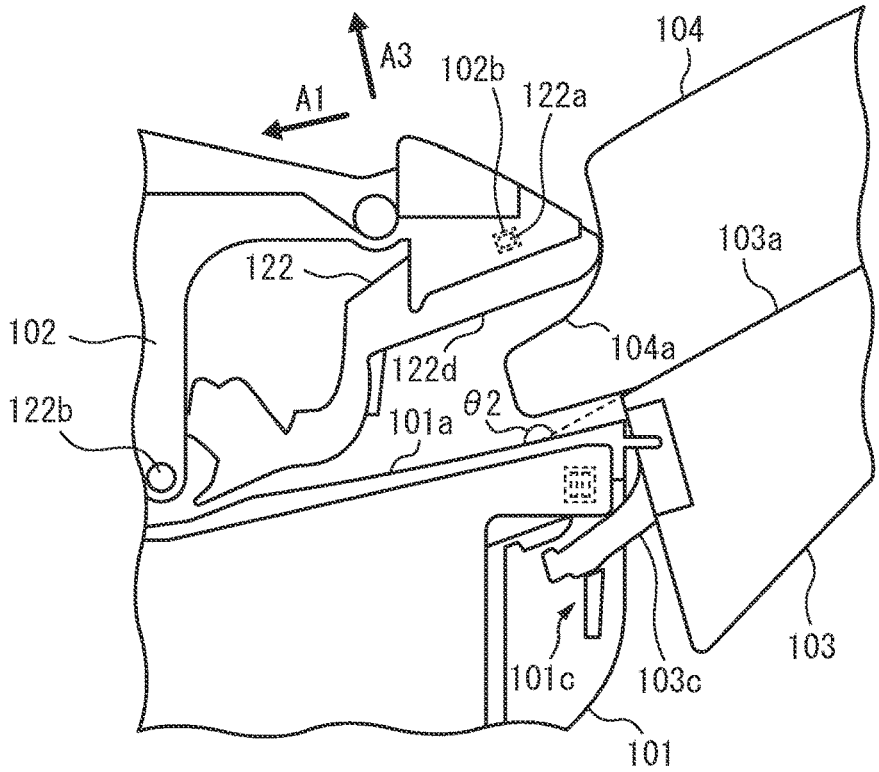
FIG. 15B is a schematic diagram for illustrating the motion of the separation roller cover.

FIGS. 15A and 15B are schematic diagrams for illustrating the motion of the separation roller cover when the loading tray is mounted to the lower housing with the separation roller cover located at the open position. FIG. 15A is a schematic diagram viewed from the side when the loading tray 103 is mounted to the lower housing 101 with the separation roller cover 122 located at the open position.

As illustrated in FIG. 15A, when the separation roller cover 122 is located at the open position, the locking part 122*a* is not fit into the locked part 102*b*, and the separation roller cover 122 floats relative to the upper housing 102. As described above, when the loading tray 103 is mounted to the lower housing 101, the loading tray 103 is located at the inclined position. When the loading tray 103 is mounted to the lower housing 101, the top surface part 104*a* of the side guide 104 provided on the loading tray 103 located at the inclined position comes into contact with the bottom surface part 122*d* of the separation roller cover 122.

FIG. 15B is a schematic diagram illustrating a situation in which the loading tray 103 is pushed into the downstream side from the position illustrated in FIG. 15A.

As illustrated in FIG. 15B, by pushing the loading tray 103 located at the inclined position into the downstream side such that the engaging part 103*c* enters the engaged part 101*c*, the top surface part 104*a* of the side guide 104 pushes up the bottom surface part 122*d* of the separation roller cover 122. Consequently, the locking part 122*a* is fit into the locked part 102*b*, and the separation roller cover 122 is locked to the upper housing 102 and is fixed to the closed position. Thus, the side guide 104 comes into contact with the separation roller cover 122 and pushes the separation roller cover 122 toward the closed position when the loading tray 103 is located at the inclined position with the separation roller cover 122 located at the open position.

When cleaning or replacing the separation roller 113 or removing a medium caught in the separation roller cover 122, a user normally opens the separation roller cover 122 after removing the loading tray 103 from the lower housing 101 in order to avoid the loading tray 103 being obstructive. Then, after cleaning or replacing the separation roller 113 or removing a medium caught in the separation roller cover 122, the user closes the separation roller cover 122. In the medium conveying apparatus 100, the separation roller cover 122 is pushed into the closed position by the side guide 104 when the loading tray 103 is mounted if the separation roller cover 122 is located at the open position. Therefore, in the medium conveying apparatus 100, the separation roller cover 122 is reliably closed by the loading tray 103 mounted to the lower housing 101 even when the user neglects to close the separation roller cover 122 or fails to close the separation roller cover 122. Accordingly, the medium conveying apparatus 100 can suppress occurrence of a conveyance abnormality, such as jamming or skewing of a medium due to the medium being conveyed while the separation roller cover 122 is in the open state.

The medium conveying apparatus 100 can close the separation roller cover 122 if it is open, by using the side guide 104 used for regulating the width direction of a medium without using a special part. Accordingly, the medium conveying apparatus 100 can suitably set the separation roller cover 122 while suppressing the increase in the apparatus cost and the apparatus size.

In the medium conveying apparatus 100, the side guide 104 is provided to push the separation roller cover 122 located at the open position upward. Consequently, the medium conveying apparatus 100 can close the separation roller cover 122 covering an area below the separation roller 113 by using the side guide 104 provided on the loading tray 103 mounted to the lower housing 101. Therefore, the medium conveying apparatus 100 can close the separation roller cover 122 failing to be closed, by using the side guide 104 without using a special part. Accordingly, the medium conveying apparatus 100 can suitably set the separation roller cover 122 while suppressing the increase in the apparatus cost and the apparatus size.

Figure 16A:
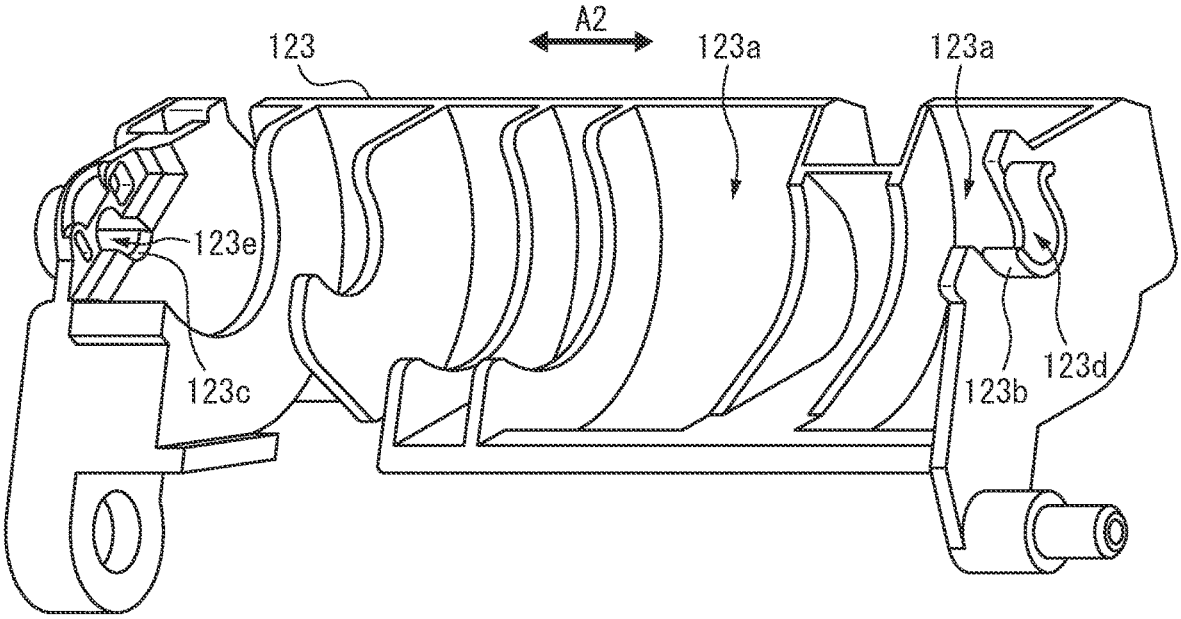
FIG. 16A is a schematic diagram for illustrating a separation roller frame.
Figure 16B:
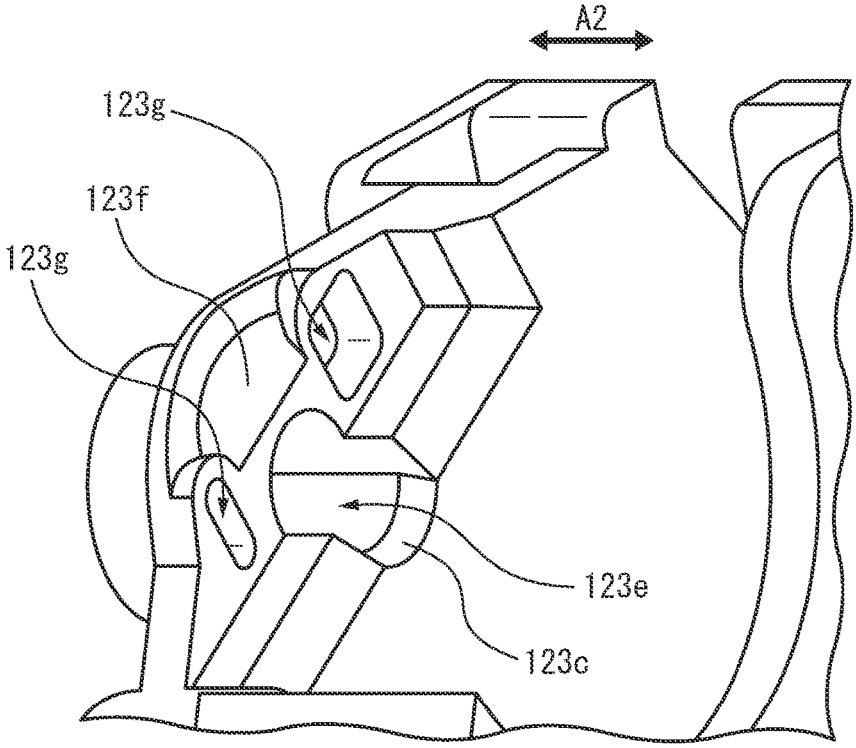
FIG. 16B is a schematic diagram for illustrating the separation roller frame.

FIGS. 16A and 16B are schematic diagrams for illustrating a separation roller frame. FIG. 16A is a schematic diagram of the separation roller frame 123 removed from the upper housing 102 viewed from inside (viewed from the medium conveyance path side).

The separation roller frame 123 is a frame rotatably supporting the separation roller 113 and is provided on the upper housing 102. The separation roller frame 123 is formed of a resin member, such as PS or ABS, and is particularly formed of a flexible member. The separation roller frame 123 is a frame for housing the separation roller 113 and is provided to open toward the medium conveyance path side when mounted to the upper housing 102. While the separation roller frame 123 is mounted to the upper housing 102, the separation roller cover 122 is located on the opposite side of the separation roller frame 123 with the separation roller 113 in between and covers the separation roller 113 along with the separation roller frame 123. A side from the separation roller frame 123 toward the medium conveyance path when the separation roller frame 123 being mounted to the upper housing 102 may be hereinafter referred to as a conveyance path side. In other words, the conveyance path side is a side from the separation roller frame 123 toward the separation roller cover 122 when the separation roller cover 122 is mounted to the separation roller frame 123.

As illustrated in FIG. 16A, the separation roller frame 123 includes a cover part 123*a*, a first support part 123*b*, and a second support part 123*c*.

The cover part 123*a* is located on the opposite side of the conveyance path side and is formed to curve such that the separation roller 113 can be housed. The first support part 123*b* includes an opening 123*d* opening toward the conveyance path side so that the first end 113*c* of the shaft 113*a* is located therein. The second support part 123*c* is an example of a support part and includes a first hole 123*e* extending in the width direction A2 so that the second end 113*d* of the shaft 113*a* is located therein. Consequently, the first support part 123*b* and the second support part 123*c* support the shaft 113*a*.

FIG. 16B is an enlarged perspective view displaying an area around the second support part 123*c*.

As illustrated in FIG. 16B, a side 123*f* of the second support part 123*c* formed on the conveyance path side of the first hole 123*e* is chamfered toward the conveyance path side. In other words, the side 123*f* is inclined such that an area further on the conveyance path side is positioned further outside in the width direction A2. Further, a second hole 123*g* is formed in an area around the second support part 123*c*. The second hole 123*g* is an example of a hole. In the example illustrated in FIG. 16B, two second holes 123*g* are formed on the left and right sides of the second support part 123*c*. The number of the second holes 123*g* is not limited to two and may be one or more than two.

Figure 17:
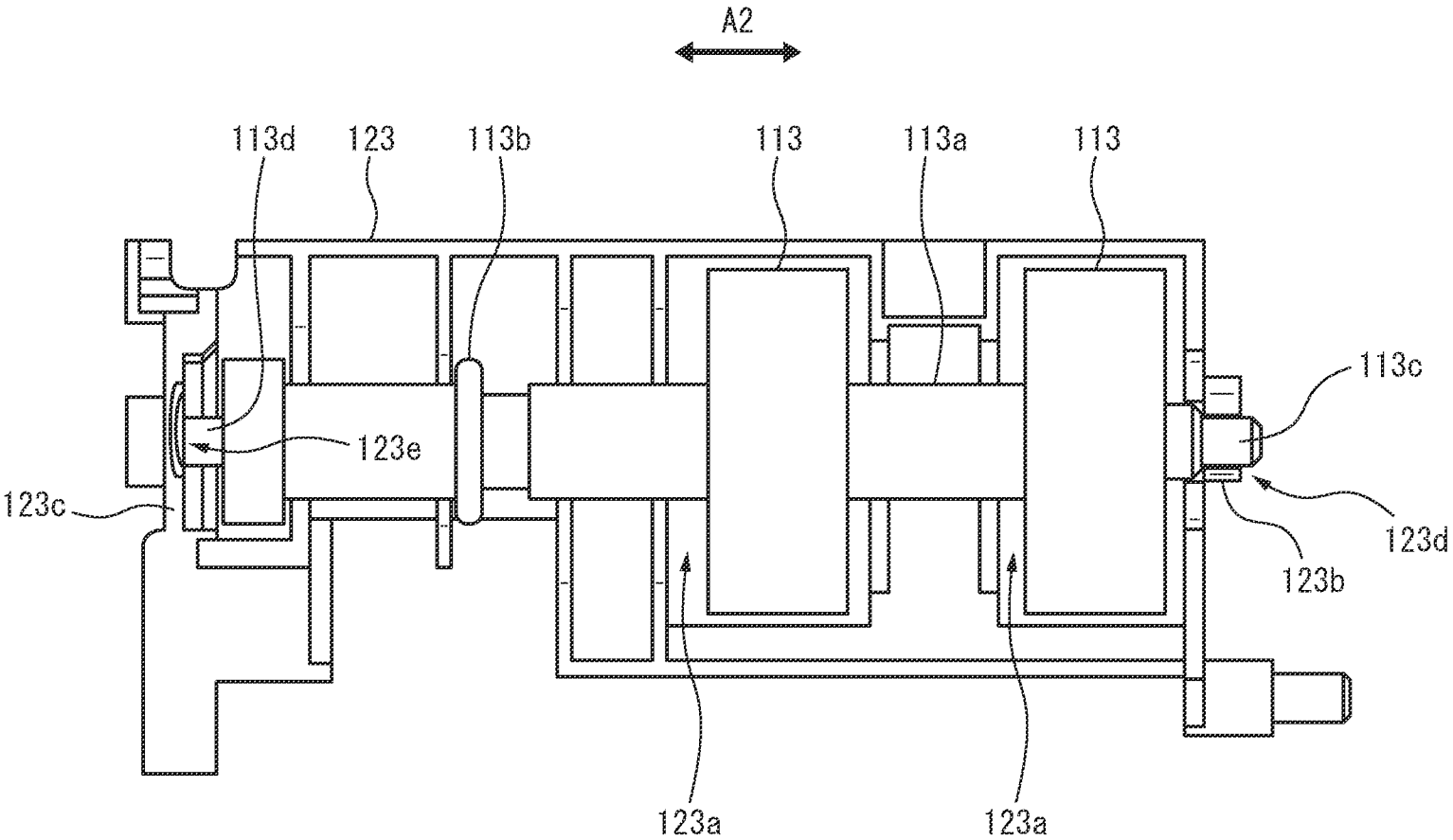
FIG. 17 is a schematic diagram for illustrating the separation roller frame.

FIG. 17 is a schematic diagram for illustrating the separation roller frame when the separation roller is located. FIG. 17 is a schematic diagram of the separation roller frame 123 viewed from the conveyance path side when the separation roller 113 is located.

As illustrated in FIG. 17, the first end 113*c* of the shaft 113*a* is located in the opening 123*d* of the first support part 123*b*, and the second end 113*d* is located in the first hole 123*e* of the second support part 123*c*. Consequently, the separation roller 113 is located to face the cover part 123*a*, and the separation roller frame 123 rotatably supports the separation roller 113.

Figure 18A:
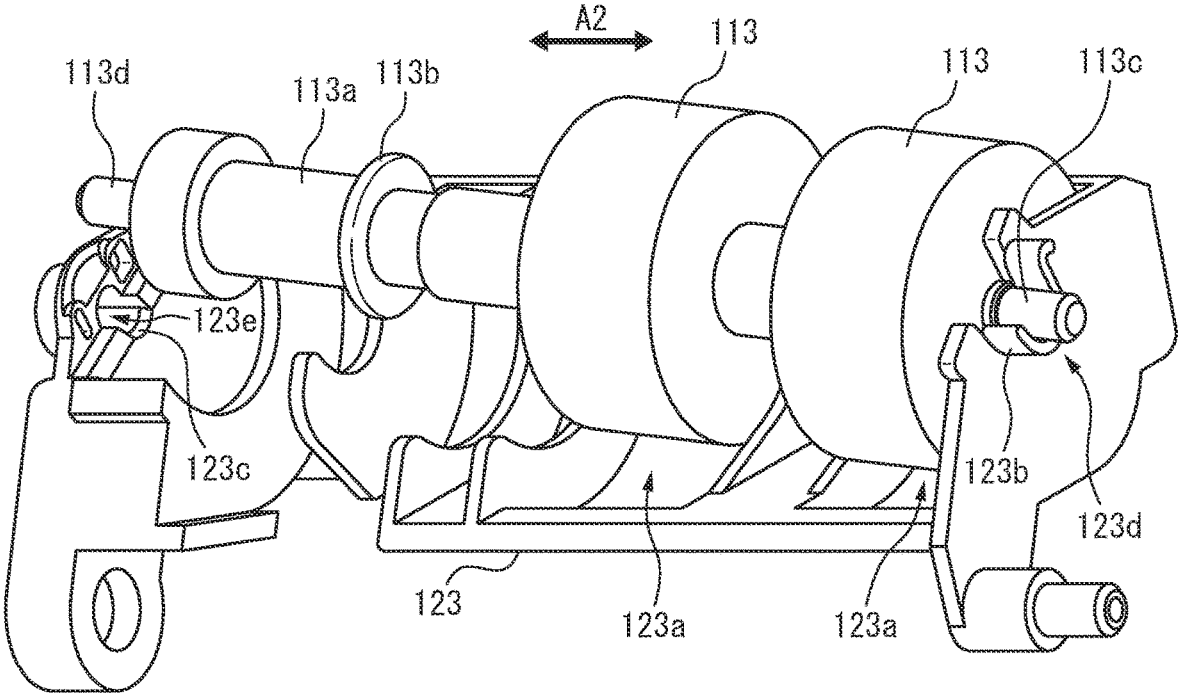
FIG. 18A is a schematic diagram for illustrating motion of the separation roller.
Figure 18B:
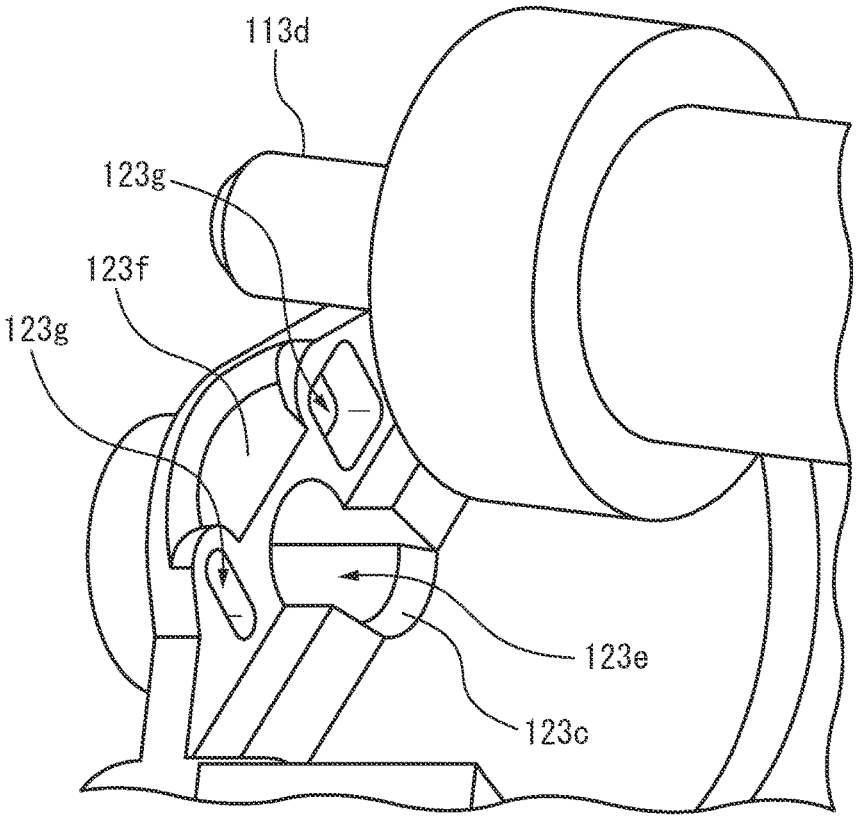
FIG. 18B is a schematic diagram for illustrating the motion of the separation roller.

FIGS. 18A and 18B are schematic diagrams for illustrating the motion of the separation roller when the separation roller cover is moved to the closed position with the separation roller located in the separation roller cover. FIG. 18A is a perspective view illustrating the separation roller 113 being mounted, and FIG. 18B is an enlarged perspective view displaying an area around the second support part 123*c*. In the example illustrated in FIGS. 18A and 18B, the upper housing 102 and the separation roller cover 122 are not illustrated for enhanced visual recognizability.

As illustrated in FIG. 13, by locating the protruding part 113*b* to engage with the recessed part 122*e* when the separation roller 113 is located in the separation roller cover 122, the separation roller 113 is positioned relative to the separation roller cover 122. When the separation roller cover 122 is moved to the closed position in this state, the separation roller cover 122 moves (swings) with the separation roller 113 located inside and is locked to the separation roller frame 123.

At this time, as illustrated in FIG. 18A, first, the first end 113*c* of the separation roller 113 located inside the separation roller cover 122 is located in the opening 123*d* of the first support part 123*b* of the separation roller frame 123. Next, as illustrated in FIGS. 18A and 18B, the second end 113*d* of the separation roller 113 moves toward the first hole 123*e* side on the side 123*f* of the separation roller frame 123 and enters the first hole 123*e*.

As described above, by each of the second end 113*d* and the side 123*f* being chamfered, the second end 113*d* is easily engaged with the first hole 123*e*. Accordingly, in the medium conveying apparatus 100, when the separation roller cover 122 is closed with the separation roller 113 located inside the separation roller cover 122, the second end 113*d* can be satisfactorily engaged with the first hole 123*e*.

As described above, the second hole 123*g* is formed in an area around the second support part 123*c*. Consequently, when the second end 113*d* enters the first hole 123*e*, a part between the first hole 123*e* and the second hole 123*g* in the second support part 123*c* is bent to the second hole 123*g* side, and the first hole 123*e* is enlarged to the second hole 123*g* side. Accordingly, in the medium conveying apparatus 100, when the separation roller cover 122 is closed with the separation roller 113 located inside the separation roller cover 122, the second end 113*d* can be satisfactorily engaged with the first hole 123*e*.

The second end 113*d* and/or the side 123*f* may not be chamfered. Alternatively, the second hole 123*g* may not be formed in an area around the second support part 123*c*. In other words, at least one of the shaft 113*a* and the second support part 123*c* is provided such that the second end 113*d* is engaged with the first hole 123*e* when the separation roller cover 122 is closed with the separation roller 113 located inside the separation roller cover 122.

Thus, in the medium conveying apparatus 100, the separation roller 113 is engaged with the separation roller frame 123 (upper housing 102) in conjunction with the motion of the separation roller cover 122 being closed. A user closes the separation roller cover 122 after locating the separation roller 113 in the separation roller cover 122 in the open state instead of directly engaging the separation roller 113 to the separation roller frame 123. Consequently, the user can readily set the separation roller 113, and the medium conveying apparatus 100 can improve user convenience.

Figure 19:
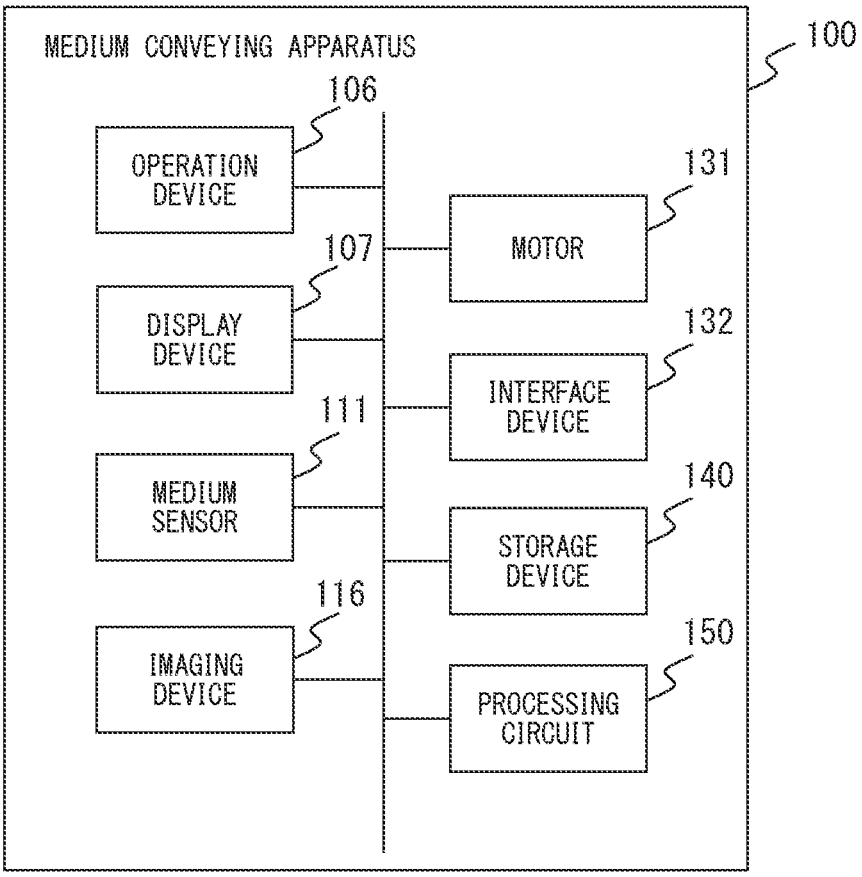
FIG. 19 is a block diagram illustrating a schematic configuration of the medium conveying apparatus.

FIG. 19 is a block diagram illustrating a schematic configuration of an example of a medium conveying apparatus.

In addition to the configuration described above, the medium conveying apparatus 100 further includes a motor 131, an interface device 132, a storage device 140, a processing circuit 150, etc.

The motor 131 includes one or a plurality of motors and conveys a medium by rotating the feed roller 112, the separation roller 113, the first conveyance roller 114, the second conveyance roller 115, the first ejection roller 117, and the second ejection roller 118 in accordance with a control signal from the processing circuit 150. One of the first conveyance roller 114 and the second conveyance roller 115 may be a driven roller driven to rotate by the other roller. One of the first ejection roller 117 and the second ejection roller 118 may be a driven roller driven to rotate by the other roller.

For example, the interface device 132 includes an interface circuit conforming to a serial bus such as USB and transmits and receives an input image and various types of information by being electrically connected to an unillustrated information processing apparatus (such as a personal computer or a mobile information terminal). A communication device including an antenna transmitting and receiving wireless signals and a wireless communication interface circuit for transmitting and receiving signals through a wireless communication line in accordance with a predetermined communication protocol may be used in place of the interface device 132. For example, the predetermined communication protocol is a wireless local area network (LAN). The communication device may include a wired communication interface circuit for transmitting and receiving signals through a wired communication line in accordance with a communication protocol such as a wired LAN.

The storage device 140 includes a memory device such as a random-access memory (RAM) or a read-only memory (ROM), a fixed disk device such as a hard disk, a portable storage device such as a flexible disk or an optical disk, etc. Further, a computer program, a database, a table, etc., that are used for various types of processing in the medium conveying apparatus 100 are stored in the storage device 140. The computer programs may be installed on the storage device 140 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 150 operates in accordance with a program stored in advance in the storage device 140. For example, the processing circuit is a central processing unit (CPU). A digital signal processor (DSP), a large scale integration (LSI), an application specific integrated circuit (ASIC), and a field-programmable gate array (FPGA) may be used as the processing circuit 150.

The processing circuit 150 is connected to the operation device 106, the display device 107, the medium sensor 111, the imaging device 116, the motor 131, the interface device 132, the storage device 140, etc., and controls the components. The processing circuit 150 performs drive control of the motor 131, imaging control of the imaging device 116, etc., based on the medium signal received from the medium sensor 111, acquires an input image from the imaging device 116, and transmits the acquired image to the information processing apparatus through the interface device 132.

Figure 20:
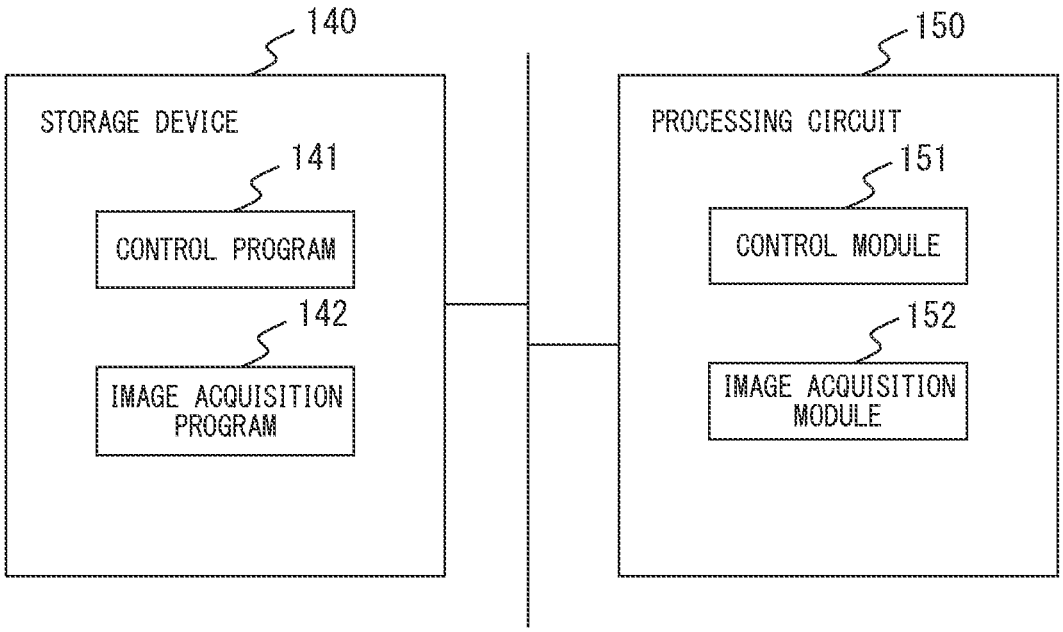
FIG. 20 is a diagram illustrating a schematic configuration of a storage device and a processing circuit.

FIG. 20 is a diagram illustrating a schematic configuration of the storage device 140 and the processing circuit.

As illustrated in FIG. 20, a control program 141, an image acquisition program 142, etc., are stored in the storage device 140. Each program is a functional module implemented by software operating on the processor. The processing circuit 150 reads each program stored in the storage device 140 and operates in accordance with the read program. Consequently, the processing circuit 150 functions as a control module 151, and an image acquisition module.

Figure 21:
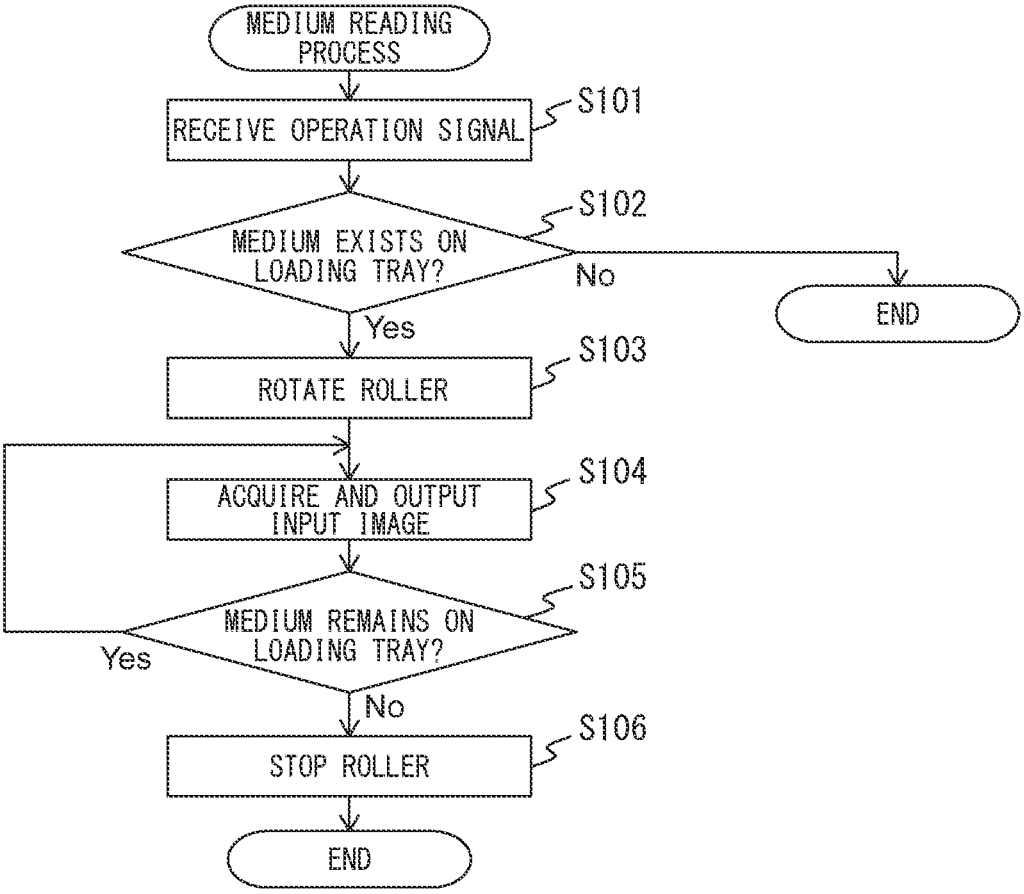
FIG. 21 is a flowchart illustrating an operation example of medium reading process.

FIG. 21 is a flowchart illustrating an operation example of medium reading process in the medium conveying apparatus.

The operation example of the medium reading process in the medium conveying apparatus 100 will be described below referring to the flowchart illustrated in FIG. 21. The operation flow described below is executed mainly by the processing circuit 150 in accordance with a program previously stored in the storage device 140 in cooperation with the components in the medium conveying apparatus 100.

First, the control module 151 waits until an instruction to read a medium is input by a user by using the operation device 106 or the information processing apparatus and an operation signal providing an instruction to read a medium is received from the operation device 106 or the interface device 132 (step S101).

Next, the control module 151 acquires the medium signal from the medium sensor 111 and determines whether a medium is placed on the loading tray 103, based on the acquired first medium signal (step S102). When a medium is not placed on the loading tray 103, the control module 151 ends the series of steps.

On the other hand, when a medium is placed on the loading tray 103, the control module 151 rotates the feed roller 112, the separation roller 113, the first conveyance roller 114, the second conveyance roller 115, the first ejection roller 117, and/or the second ejection roller 118 (step S103). The control module 151 rotates each roller to convey a medium by driving the motor 131.

Next, the control module 151 acquires an input image from the imaging device 116 by controlling the imaging device 116 to image the medium and outputs the acquired input image by transmitting the image to the information processing apparatus through the interface device 132 (step S104).

Next, the control module 151 determines whether a medium remains on the loading tray 103, based on the medium signal received from the medium sensor 113 (step S105). When a medium remains on the loading tray 103, the control module 151 returns the process to step S104 and repeats the processing in step S104 and S105.

On the other hand, when a medium does not remain in the loading tray 103, the control module 151 stops the feed roller 112, the separation roller 113, the first conveyance roller 114, the second conveyance roller 115, the first ejection roller 117, and/or the second ejection roller 118 (step S106). The control module 151 controls the motor 131 to stop each roller and ends the series of steps.

As described in detail above, in the medium conveying apparatus 100, when the loading tray 103 is mounted with the feed roller cover 121 or the separation roller cover 122 open, the loading tray 103 comes into contact with each cover and each cover is closed in conjunction with the motion of the loading tray 103 being mounted. Accordingly, the medium conveying apparatus 100 can be prevented from being used with the feed roller cover 121 or the separation roller cover 122 open.

Consequently, the medium conveying apparatus 100 can suppress occurrence of a conveyance abnormality, such as jamming or skewing of a medium. Further, a user does not need to confirm whether each cover is locked to a housing after opening the feed roller cover 121 or the separation roller cover 122, and the medium conveying apparatus 100 can improve productivity of scanning work by the user.

In the medium conveying apparatus 100, the loading tray 103 is attachably and detachably provided. Therefore, a user can readily remove and compactly house the loading tray 103 when the device is not in use. Further, the user can readily remove the loading tray 103 and remove a medium when jamming of the medium occurs. Further, in the medium conveying apparatus 100, the feed roller cover 121 or the separation roller cover 122 is openably and closably provided. Therefore, for example, when abrasion of a roller, adherence of paper dust to the roller, or jamming of a medium occurs, a user can readily perform replacement of the roller, cleaning of the roller, or elimination of the jammed medium.

Figure 22A:
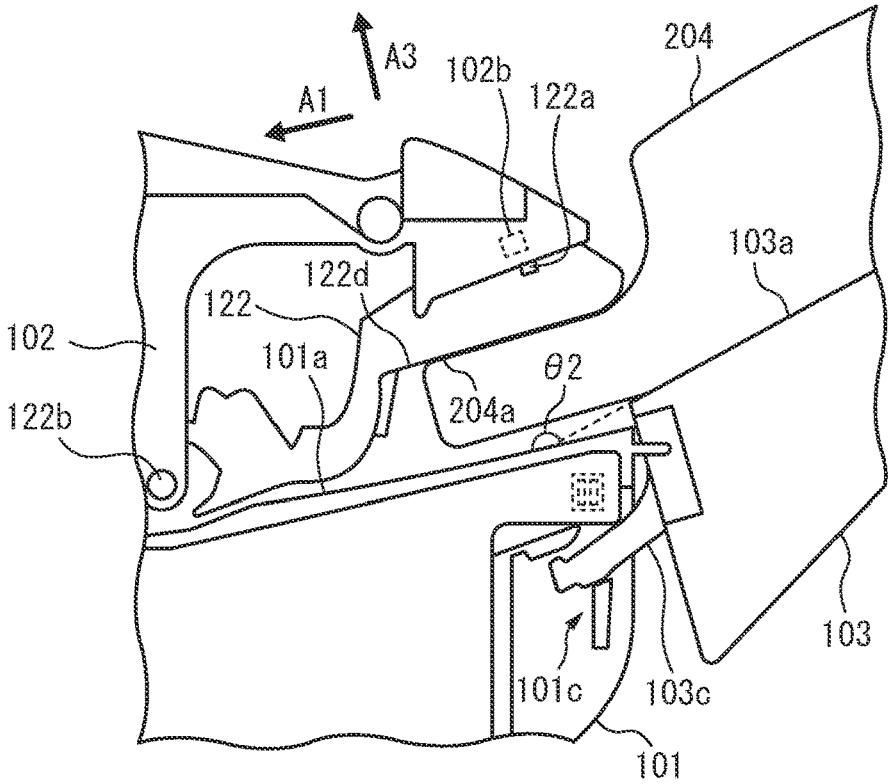
FIG. 22A is a schematic diagram for illustrating another side guide.
Figure 22B:
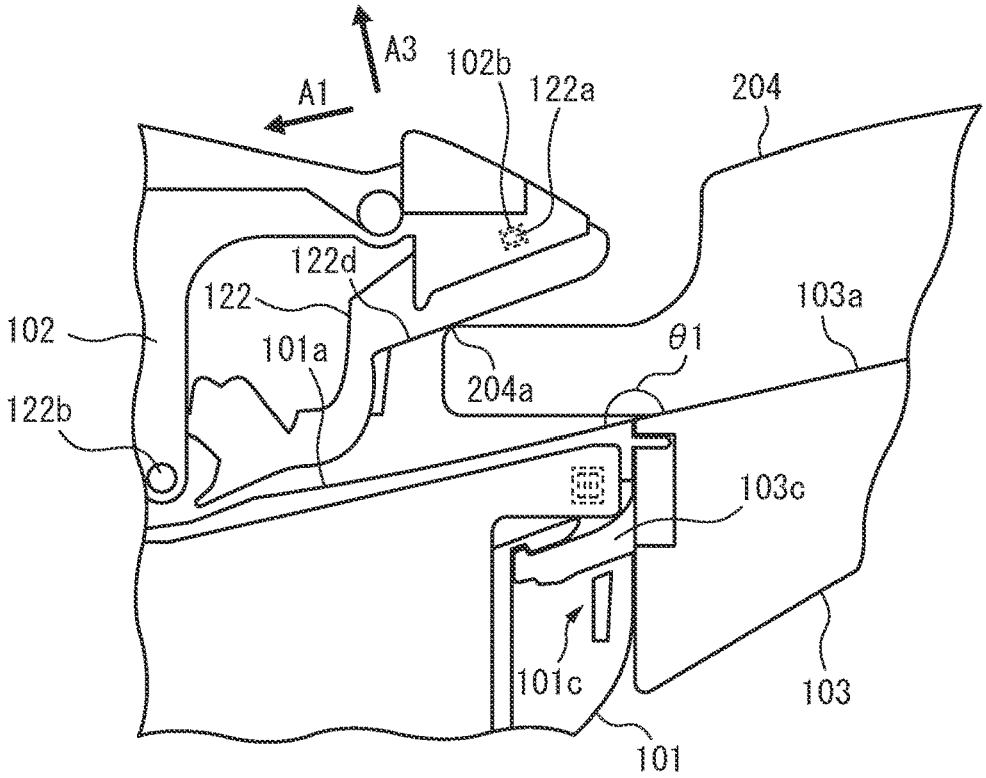
FIG. 22B is a schematic diagram for illustrating the side guide.

FIGS. 22A and 22B are schematic diagrams for illustrating a side guide in a medium conveying apparatus according to another embodiment. FIG. 22A is a schematic diagram viewed from the side when the loading tray 103 is mounted to the lower housing 101 with the separation roller cover 122 located at an open position. FIG. 22B is a schematic diagram illustrating a situation in which the loading tray 103 moves from the inclined position illustrated in FIG. 22A to the fixed position.

As illustrated in FIGS. 22A and 22B, in the medium conveying apparatus according to the present embodiment, a side guide 204 is provided on the placement surface 103*a* of the loading tray 103 in place of the side guide 104. The side guide 204 has a structure similar to that of the side guide 104. A top surface part 204*a* of the side guide 204 is provided to come into contact with the separation roller cover 122 and push the separation roller cover 122 toward the closed position when the loading tray 103 moves from the inclined position to the fixed position with the separation roller cover 122 located at the open position.

As described above, the loading tray 103 is located at the inclined position when mounted to the lower housing 101. As illustrated in FIG. 22A, in the medium conveying apparatus according to the present embodiment, the locking part 122*a* is not fit into the locked part 102*b* when the loading tray 103 is located at the inclined position with the separation roller cover 122 located at the open position. The separation roller cover 122 is floats relative to the upper housing 102 without being pushed into the closed position.

On the other hand, as illustrated in FIG. 22B, by moving the loading tray 103 from inclined position to the fixed position (pushed down), the top surface part 204*a* of the side guide 204 comes into contact with the bottom surface part 122*d* of the separation roller cover 122 and pushes up the bottom surface part 122*d*. Consequently, the locking part 122*a* is fit into the locked part 102*b*, and the separation roller cover 122 is locked to the upper housing 102 and is fixed to the closed position. Thus, the side guide 204 comes into contact with the separation roller cover 122 and pushes the separation roller cover 122 toward the closed position when the loading tray 103 moves from the inclined position to the fixed position with the separation roller cover 122 located at the open position.

As described in detail above, the medium conveying apparatus can be prevented from being used with the separation roller cover 122 open when the side guide 204 pushes the separation roller cover 122 toward the closed position at the time when the loading tray 103 moves from the inclined position to the fixed position as well.

Figure 23:
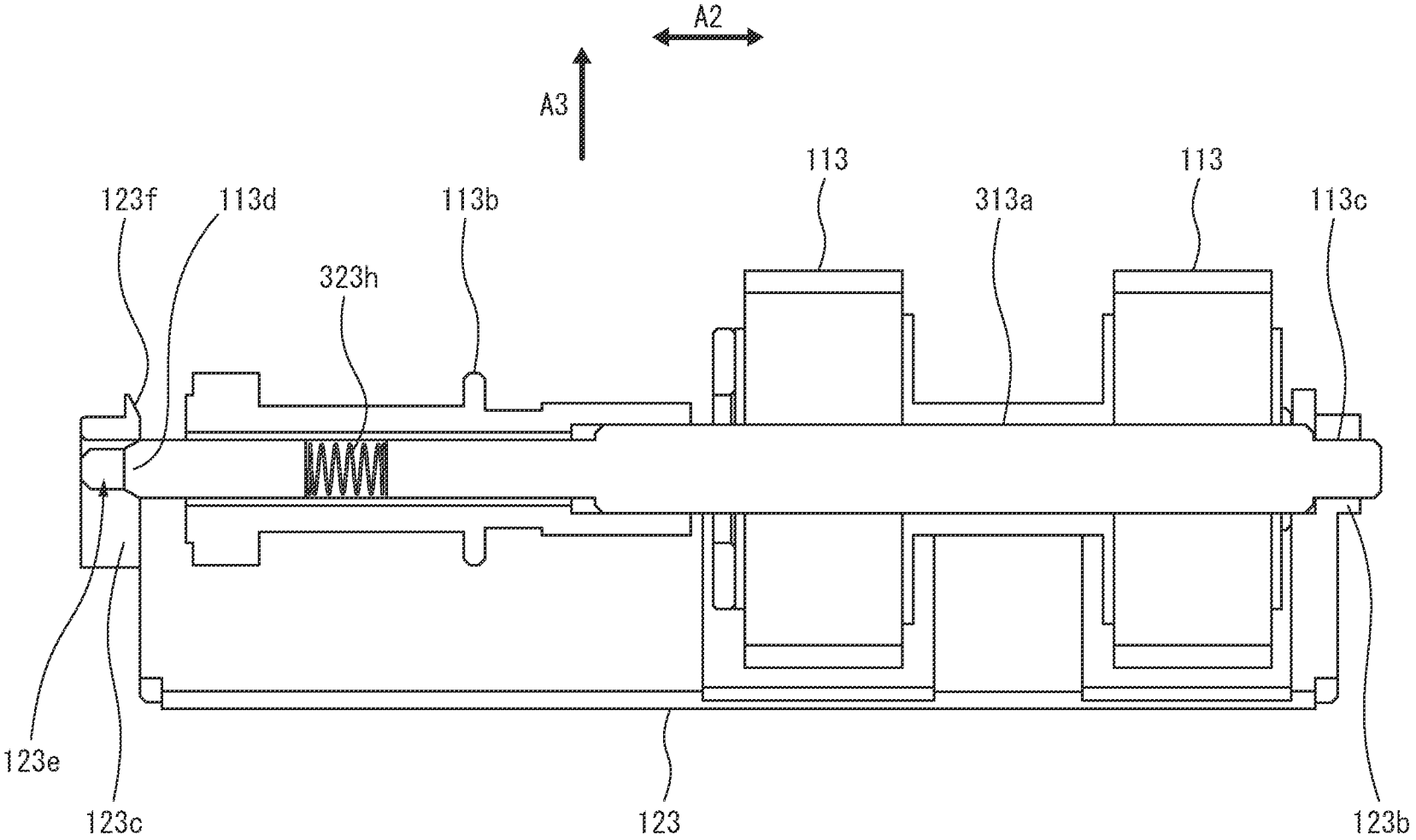
FIG. 23 is a schematic diagram for illustrating another shaft.

FIG. 23 is a schematic diagram for illustrating a shaft of the separation roller in a medium conveying apparatus according to yet another embodiment. FIG. 23 is a cross-sectional view of the separation roller frame 123 viewed from the downstream side when the shaft 313*a* of the separation roller 113 is located.

As illustrated in FIG. 23, in the medium conveying apparatus according to the present embodiment, the separation roller 113 is provided on the shaft 313*a* instead of on the shaft 113*a*. The shaft 313*a* has a structure similar to that of the shaft 113*a*. An elastic member 323*h* is provided inside the shaft 313*a*. The elastic member 323*h* is a spring member such as a helical torsion coil spring. For example, the elastic member 323*h* may be another type of spring member, such as a flat spring, or a rubber member. The elastic member 323*h* is located at any position between the second end 113*d* and the separation roller 113 and applies an outward pressing force to the second end 113*d* along an extending direction of the shaft 313*a* (a width direction A2). Consequently, the second end 113*d* of the shaft 313*a* is provided to be movable in the extending direction of the shaft 313*a*.

When the second end 113*d* of the shaft 313*a* moves toward the first hole 123*e* of the second support part 123*c* on the side 123*f*, the second end 113*d* pushes back the elastic member 323*h* and moves to the first support part 123*b* side. Accordingly, in the medium conveying apparatus, the second end 113*d* can be more reliably engaged with the first hole 123*e* when the separation roller cover 122 is closed with the separation roller 113 located inside the separation roller cover 122.

Consequently, a user can more reliably set the separation roller 113 in the separation roller frame 123, and the medium conveying apparatus can improve user convenience.

As described in detail above, the medium conveying apparatus can be prevented from being used with the feed roller cover 121 or the separation roller cover 122 open when the shaft 313*a* includes the elastic member 323*h* as well.

Figure 24:
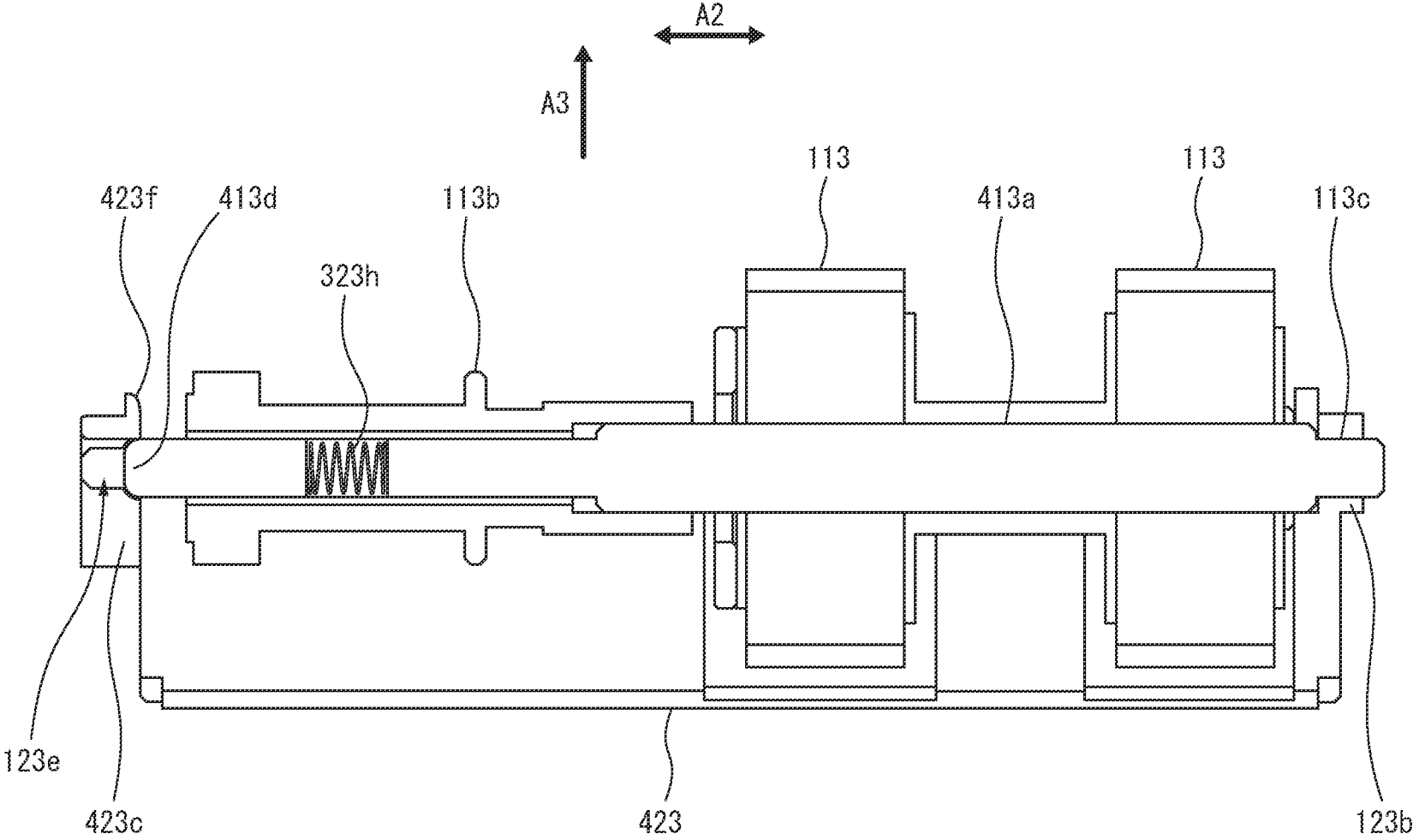
FIG. 24 is a schematic diagram for illustrating another shaft.

FIG. 24 is a schematic diagram for illustrating a shaft of the separation roller and a second support part of a separation roller frame in a medium conveying apparatus according to yet another embodiment. FIG. 24 is a cross-sectional view of the separation roller frame 423 viewed from the downstream side when the shaft 413*a* of the separation roller 113 is located.

As illustrated in FIG. 24, in the medium conveying apparatus according to the present embodiment, the separation roller 113 is provided on the shaft 413*a* instead of on the shaft 113*a* or 313*a*. The shaft 413*a* has a structure similar to that of the shaft 113*a* or 313*a*. A second end 413*d* of the shaft 413*a* is rounded.

The medium conveying apparatus according to the present embodiment further includes the separation roller frame 423 in place of the separation roller frame 123. The separation roller frame 423 includes the second support part 423*c* in place of the second support part 123*c*. A side 423*f* formed in the second support part 423*c* on a conveyance path side relative to a first hole 123*e* is rounded toward the conveyance path side. In other words, the side 423*f* is inclined such that an area further on the conveyance path side is positioned further outward in a width direction A2.

Because each of the second end 413*d* and the side 423*f* is rounded, when the separation roller cover 122 is moved to the closed position, the second end 413*d* moves inward in the width direction A2 along the side 423*f*. Consequently, as the second end 413*d* approaches the first hole 123*e*, the shaft 413*a* of the separation roller 113 moves toward the first support part 123*b* side. Accordingly, in the medium conveying apparatus, the second end 413*d* can be satisfactorily engaged with the first hole 123*e* when the separation roller cover 122 is closed with the separation roller 113 located inside the separation roller cover 122.

Either one of the second end 413*d* and the side 423*f* may not be rounded.

As described in detail above, the medium conveying apparatus can be prevented from being used with the feed roller cover 121 or the separation roller cover 122 open when the second end 413*d* or the side 423*f* is rounded as well.

Figure 25:
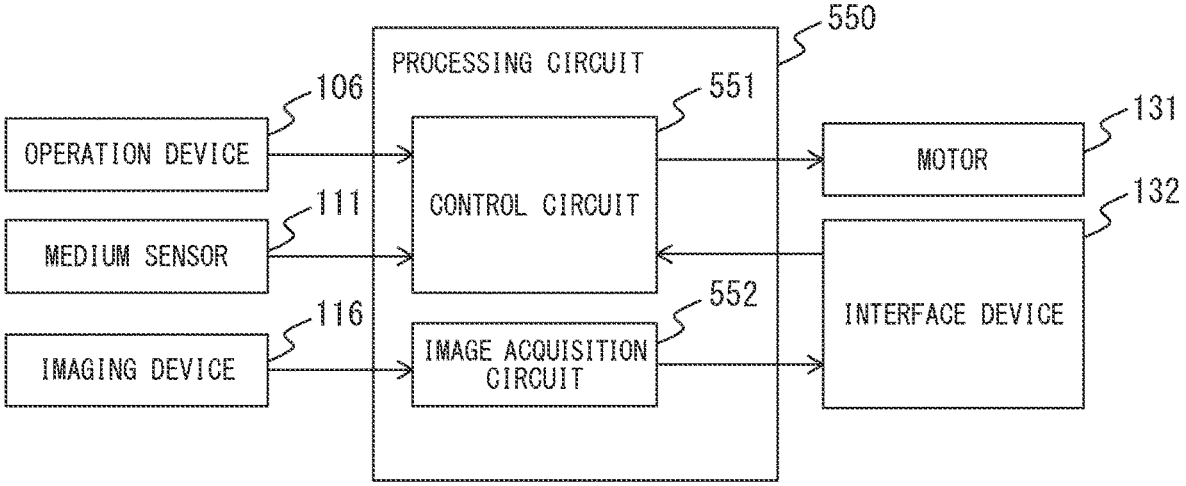
FIG. 25 is a diagram illustrating a schematic configuration of another processing circuit.

FIG. 25 is a diagram illustrating a schematic configuration of a processing circuit in a medium conveying apparatus according to yet another embodiment. The processing circuit 550 is used in place of the processing circuit 150 in the medium conveying apparatus 100 and executes medium reading process, etc., in place of the processing circuit 150. The processing circuit 550 includes a control circuit 551, an image acquisition circuit 552, etc. For example, the components may be independently configured with an integrated circuit, a microprocessor, or firmware.

The control circuit 551 is an example of a control module and has a function similar to that of the control module 151. The control circuit 551 receives the operation signal from the operation device 106 or the interface device 132 and the medium signal from the medium sensor 111. The control circuit 551 controls the motor 131, based on the received information.

The image acquisition circuit 552 is an example of an image acquisition module and has a function similar to that of the image acquisition module 152. The image acquisition circuit 552 acquires the input image from the imaging device 116 and outputs the acquired image to the interface device 132.

As described in detail above, the medium conveying apparatus can be prevented from being used with the feed roller cover 121 or the separation roller cover 122 open when the processing circuit 550 is used as well.

While preferred embodiments have been described above, the embodiment is not limited thereto. For example, the recessed part 103*d* of the loading tray 103 may be formed to come into contact with the feed roller cover 121 and push the feed roller cover 121 toward the closed position when the loading tray 103 is located at the inclined position with the feed roller cover 121 located at the open position. In that case, the upper edge of the recessed part 103*d* provided on the downstream side 103*b* of the loading tray 103 is formed to be inclined such that an area further on the upstream side is positioned further downward. Consequently, when the loading tray 103 slides to the downstream side with located at the inclined position, the recessed part 103*d* of the loading tray 103 can push the feed roller cover 121 downward and push the cover toward the closed position.

The feed roller 112 and the feed roller cover 121 may have structures similar to those of the separation roller 113 and the separation roller cover 122 and may be provided such that the feed roller 112 is engaged with the lower housing 101 in conjunction with the motion of the feed roller cover 121 being closed. In that case, the feed roller 112 is attachably and detachably provided on the lower housing 101. A support part rotatably supporting a shaft being the rotation axis of the feed roller 112 is provided on the lower housing 101. The shaft of the feed roller 112 and the support part of the lower housing 101 have structures similar to those of the shaft 113*a* of the separation roller 113 and the second support part 123*c* of the separation roller frame 123, respectively. At least one of the shaft and the support part is provided such that the shaft is engaged with the support part when the feed roller cover 121 is closed with the feed roller 112 located inside the feed roller cover 121.

The engaging part 103*c* of the loading tray 103 and the engaged part 101*c* of the lower housing 101 may be provided to be engaged with (fit) each other only when the feed roller cover 121 and/or the separation roller cover 122 is located at the closed position. In other words, the engaging part 103*c* and the engaged part 101*c* may be provided not to be engaged with (fit) each other when the feed roller cover 121 and/or the separation roller cover 122 is located at the open position. Consequently, the loading tray 103 is not mounted to the lower housing 101 when the feed roller cover 121 or the separation roller cover 122 is not locked, and therefore a user can reliably recognize that the cover is not correctly set.

Similarly, the engaging part 103*c* and the engaged part 101*c* may be provided to be engaged with (fit) each other only when the feed roller 112 is engaged with the lower housing 101 and/or only when the separation roller 113 is engaged with the upper housing 102. In other words, the engaging part 103*c* and the engaged part 101*c* may be provided not to be engaged with (fit) each other when the feed roller 112 is not engaged with the lower housing 101 or when the separation roller 113 is not engaged with the upper housing 102. Consequently, the loading tray 103 is not mounted to the lower housing 101 when the feed roller 112 or the separation roller 113 is not correctly set, and therefore a user can reliably recognize that the roller is not correctly set.

A protruding part may be provided on the loading tray 103, and a recessed part may be provided on the feed roller cover 121. In that case, the protruding part protruding toward the downstream side is provided at the downstream side edge of the loading tray 103, and the recessed part is provided at the upstream side edge of the feed roller cover 121. The protruding part provided on the loading tray 103 comes into contact with the lower edge of the recessed part provided on the feed roller cover 121 and pushes down the feed roller cover.

Only one of the feed roller cover 121 and the separation roller cover 122 may be provided so as to move to the closed position in conjunction with the motion of the loading tray 103 when the loading tray is mounted with the one of the feed roller cover 121 and the separation roller cover 122 located at the open position.

REFERENCE SIGNS LIST

100 Medium conveying apparatus, 101 Lower housing, 101*a* Lower guide surface, 102 Upper housing, 102*a* Upper guide surface, 103 Loading tray, 103*a* Placement surface, 103*d* Recessed part, 104 Side guide, 112 Feed roller, 113 Separation roller, 113*a*, 313*a*, 413*a* Shaft, 113*d*, 413*d* Second end, 121 Feed roller cover, 121*b* Shaft part, 122 Separation roller cover, 122*b* Shaft part, 123*c* Second support part, 123*g* Second hole

The invention claimed is:

1. A medium conveying apparatus comprising:

a housing including an engaged part and a guide surface of a medium;

a loading tray, including an engaging part which can be engaged with the engaged part and a placement surface on which the medium is placed, attachable and detachable relative to the housing, wherein the engaging part is engaged with the engaged part when the guide surface and the placement surface form a first angle, and entering or removing of the loading tray to the housing is allowed when the guide surface and the placement surface form a second angle different from the first angle;

a roller attachable and detachable relative to the housing; and a cover openable and closable relative to the housing, wherein the cover forms part of the guide surface when the cover closes and the roller can be attached and detached when the cover opens, wherein a contact part to come into contact with the cover is provided on the loading tray or on a side guide provided on the loading tray to regulate a width direction of a medium, and wherein the contact part pushes the cover in a direction in which the cover closes when an angle formed by the guide surface and the placement surface is changed from the second angle to the first angle.

2. The medium conveying apparatus according to claim 1, wherein the cover is configured to be swingable relative to the housing around a shaft provided at a downstream side edge in a medium conveying direction.

3. The medium conveying apparatus according to claim 1, wherein the second angle is less than the first angle.

4. The medium conveying apparatus according to claim 1, wherein the cover covers an area above the roller, and wherein the contact part is configured to push the cover located at an open position downward.

5. The medium conveying apparatus according to claim 4, wherein the contact part is provided at a downstream side edge of the loading tray in a medium conveying direction to come into contact with an upstream side edge of the cover in the medium conveying direction.

6. The medium conveying apparatus according to claim 1, wherein the cover covers an area below the roller, and wherein the contact part is configured to push the cover located at the open position upward.

7. The medium conveying apparatus according to claim 1, wherein the roller is attachably and detachably provided on the housing, wherein the housing includes a recess to support a rotation axis of the roller, and wherein at least one of the rotation axis and the recess is provided such that the rotation axis is supported in the recess when the cover is closed with the roller located inside the cover.

8. The medium conveying apparatus according to claim 7, wherein at least one of an end of the rotation axis and the recess is chamfered or rounded.

9. The medium conveying apparatus according to claim 7, wherein a hole is formed in an area around the recess.

10. The medium conveying apparatus according to claim 7, wherein an end of the rotation axis is configured to be movable in an extending direction of the rotation axis.

* * * * *